US011603634B2

(12) United States Patent
Mateychuk

(10) Patent No.: US 11,603,634 B2
(45) Date of Patent: Mar. 14, 2023

(54) MODULAR TRAFFIC CONTROL DEVICE

(71) Applicant: Roadshark International Inc., Winnipeg (CA)

(72) Inventor: Jonathon R. Mateychuk, Winnipeg (CA)

( * ) Notice: Subject to any disclaimer, the term of this patent is extended or adjusted under 35 U.S.C. 154(b) by 238 days.

(21) Appl. No.: 16/710,256

(22) Filed: Dec. 11, 2019

(65) Prior Publication Data

US 2020/0181860 A1 Jun. 11, 2020

Related U.S. Application Data

(63) Continuation-in-part of application No. 16/215,941, filed on Dec. 11, 2018.

(60) Provisional application No. 62/884,777, filed on Aug. 9, 2019.

(51) Int. Cl.
*E01F 13/12* (2006.01)
*G08B 5/36* (2006.01)

(52) U.S. Cl.
CPC ..... *E01F 13/123* (2013.01); *G08B 5/36* (2013.01)

(58) Field of Classification Search
CPC ..... E01F 13/123
See application file for complete search history.

(56) References Cited

U.S. PATENT DOCUMENTS 1,563,637 A * 12/1925 Lundblad ..... E01F 13/123 49/49
4,318,079 A * 3/1982 Dickinson ..... E01F 13/123 116/52
5,498,102 A * 3/1996 Bissell ..... E01F 13/12 404/9
5,507,588 A * 4/1996 Marts ..... E01F 13/123 256/1
5,588,774 A * 12/1996 Behan ..... E01F 13/123 404/6
5,733,063 A * 3/1998 Bailey ..... E01F 13/123 404/6
6,045,293 A * 4/2000 Dickinson ..... E01F 13/123 256/1
6,409,418 B1 * 6/2002 Blair ..... E01F 13/123 404/6

(Continued)

*Primary Examiner* — Thomas B Will
*Assistant Examiner* — Katherine J Chu
(74) *Attorney, Agent, or Firm* — Ryan W. Dupuis; Kyle R. Satterthwaite; Ade & Company Inc.

(57) ABSTRACT

A traffic control device, for a roadway receiving vehicles travelling longitudinally along the roadway, includes a housing, which may be formed in two or more modular sections, mounted transversely across the roadway. A frame comprised of a shaft supporting tire puncturing members thereon is rotatable within the housing between stored and working positions for selectively puncturing tires. In modular embodiments, the shaft of each module includes a joiner plate supported at one end of the shaft to enable rigid connection between the shafts of adjacent modules. In some embodiments, offset counterweights are coupled to the frame to bias the tire puncture members towards the working position, and an upper stop member on the housing, formed of resilient material, is engaged by the frame in the working position and is adjustable in height to control position of the tire puncturing members in the working position.

20 Claims, 19 Drawing Sheets

(56) References Cited

U.S. PATENT DOCUMENTS

| | | | | |
|---|---|---|---|---|
| 6,474,903 | B1 * | 11/2002 | Marts | E01F 13/123 404/6 |
| 7,025,526 | B2 | 4/2006 | Blair | |
| 2005/0265781 | A1 * | 12/2005 | Blair | E01F 13/12 404/6 |
| 2008/0014017 | A1 * | 1/2008 | Liao | E01F 13/123 404/6 |
| 2015/0252540 | A1 * | 9/2015 | Lee | E01F 13/123 404/6 |

* cited by examiner

MODULAR TRAFFIC CONTROL DEVICE

This application is a continuation-in-part of U.S. parent application Ser. No. 16/215,941, filed Dec. 11, 2018, and also claims the benefit under 35 U.S.C. 119(e) of U.S. provisional application Ser. No. 62/884,777, filed Aug. 9, 2019.

FIELD OF THE INVENTION

The present invention relates to a traffic control device having a housing arranged to be supported across a roadway and which includes a plurality of tire puncturing members which are supported within the housing for pivotal movement between stored position retracted into the housing and a working position protruding upwardly from the housing. In one instance, the present invention relates to a traffic control device in which the housing and the tire puncturing members within the housing are provided in modular sections which can be readily assembled together to vary a length of the traffic control device.

BACKGROUND

There are a variety of applications in the field of directing vehicular traffic where it is desirable to allow passage of vehicles in a first direction at a controlled location while preventing flow of traffic in the opposing direction. Examples include entrance and exit locations of parking structures, parking lots, or even entire neighbourhoods. A common device for limiting the flow of traffic in one direction involves the housing mounted across the direction of traffic on a roadway in which a plurality of tire puncturing members are pivotally supported within the housing such that each member protrudes upwardly from the housing in a working orientation which is adapted to puncture tires in response to vehicles travelling over the housing in a first direction while being adapted to readily pivot into a retracted position within the housing without damaging tires in response to vehicles travelling over the housing into an opposing second direction.

U.S. Pat. No. 5,588,774 by Behan and U.S. Pat. No. 7,025,526 by Blair disclose examples of typical traffic control devices as described above which are formed in modular sections. In both devices, within each modular section, the tire puncturing members are supported on a common section of shaft in which adjacent sections of shaft are joined by suitable socket connections. In order to allow the end of one shaft section to be received within the socket at the end of another shaft to connect the shafts in series with one another, the socket connections must be machined with very small tolerances at great cost and complexity; however, even under these circumstances there tends to be some relative movement that is permitted between the adjacent shaft sections in the order of a few degrees about the axis of rotation thereof. When numerous modules are connected in series, the resulting error in angular position between the first shaft section at one end of the assembly and the last shaft section at the other end of the assembly can be sufficient to cause some of tire puncturing members to be positioned at an unsuitable orientation during actuation that is not effective for puncturing tires as desired.

Furthermore, U.S. Pat. No. 5,588,774 by Behan and U.S. Pat. No. 7,025,526 by Blair disclose examples of typical traffic control devices in which the tire puncturing members are biased into the working position using springs; however, the springs required considerable cost and labour to maintain and replace due to the frequent failure of the springs resulting from the large number of cycles that the traffic device undergoes in high traffic areas. Known traffic control devices may also be undesirable in certain applications due to the considerable noise generated by the metallic parts being cycled between working and retracted positions of the tire puncturing members with each passing vehicle. Known constructions of traffic control devices also provide limited ability to calibrate the positioning of the various operating components relative to the housing in a manner that ensures the optimal performance of the tire puncturing members to be effective at puncturing tires of vehicles passing in the wrong direction without being cumbersome to vehicles passing in the permissible direction.

SUMMARY OF THE INVENTION

According to one aspect of the invention there is provided a traffic control module for use with a roadway receiving vehicles travelling longitudinally along the roadway in a travel direction, the traffic control module comprising:

a main housing which is elongate in a longitudinal direction and which is adapted to be mounted to extend across the roadway transversely to the travel direction;

the main housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein;

a joiner plate supported at each end of the shaft assembly locating at least one fastener aperture therein such that the joiner plate is adapted to be rigidly connected to the joiner plate of an auxiliary module of identical configuration to the traffic control module when the housings of the modules are longitudinally in series with one another such that the tire puncturing members of the modules are pivotal together between the storage positions and the working positions thereof.

The use of joiner plates that are fixed at opposing ends of the shaft assembly for connection to adjacent modules with radially offset fasteners allows the shaft sections to be accurately positioned in angular orientation relative to one another and then fixed relative to one another in angular alignment with one another in a low-cost manufacturing manner.

Preferably at least one of the joiner plates includes a pointed end which pivots together with the pointed ends of the tire puncturing members between the storage position below the upper supporting surface and the working position protruding upwardly beyond the upper supporting surface so as to be adapted for puncturing tires.

When the tire puncturing members are evenly spaced apart along the pivot axis from one another by a prescribed spacing, preferably each joiner plate is spaced along the pivot axis from an outermost one of the tire puncturing members by said prescribed spacing.

Each joiner plate may have a thickness in an axial direction of the shaft assembly which is approximately half of a thickness of each tire puncturing member such that a combined thickness of the joiner plates when rigidly connected is equal to a thickness of the tire puncturing members.

Preferably one of the joiner plates includes a socket formed therein and the other joiner plate includes a protrusion formed therein which is arranged to be matingly received within the socket of the joiner plate of the auxiliary module of identical configuration when the joiner plates are rigidly connected. The socket and protrusion may be coaxially aligned with the pivot axis to assist coaxial alignment of the shaft assemblies.

The traffic control module is preferably used in combination with a controller module that also comprises (i) a main housing which is elongate in a longitudinal direction between a first end and a second end, which is adapted to be mounted to extend across the roadway transversely to the travel direction, and which has an upper supporting surface adapted to support the vehicles rolling over the housing, (ii) a plurality of upper openings formed in the upper supporting surface of the main housing, (iii) a plurality of tire puncturing members having respective pointed ends adapted to puncture tires of the vehicles, and (iv) a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein. The controller module preferably also includes (i) a controller housing connected to the first end of the main housing, (ii) an actuating linkage within the controller housing in connection with a first end of the shaft assembly of the controller module for displacing the tire puncturing members of the controller module between the storage and working positions, and (iii) a joiner plate supported at a second end of the shaft assembly which is adapted to be coupled to the joiner plate of the traffic control module when the controller module and the traffic control module are positioned longitudinally in series with one another such that the tire puncturing members of the modules are pivotal together between the storage positions and the working positions thereof.

The traffic control module and the controller module according to the preferred embodiment are substantially equal in length in the longitudinal direction.

The controller housing preferably also supports an indicator assembly thereon including a first indicator which is visually indicative of the tire puncturing members being in the storage position and a second indicator which is visually indicative of the tire puncturing members being in the working position.

In one embodiment, the shaft assembly protrudes longitudinally beyond the main housing at both ends of the shaft assembly such that the joiner plates at both ends of the shaft assembly are supported externally of the housing. In this instance, the main housing of the auxiliary module and the main housing of the traffic control module may be longitudinally spaced apart when the joiner plates of the modules are rigidly connected to one another. The traffic control module in this instance may be adapted to be supported fully above an upper road surface of the roadway.

In an alternative embodiment, a first end of the shaft assembly protrudes longitudinally beyond the main housing such that the joiner plate at the first end is supported externally of the housing and a second end of the shaft assembly is recessed longitudinally inwardly relative to a corresponding end of the main housing such that the joiner plate at the second end is supporting internally within the housing. In this instance, the main housing of the auxiliary module and the main housing of the traffic control module may be coupled in abutment with one another when the joiner plates of the modules are rigidly connected to one another. The traffic control module in this instance may be adapted to be supported at least partially recessed below an upper road surface of the roadway.

According to a second aspect of the present invention there is provided a traffic control device for use with a roadway receiving vehicles travelling longitudinally along the roadway in a travel direction, the device comprising at least two modules in which each module comprises:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein; and a joiner plate supported at one end of the shaft assembly;

the joiner plates of the two modules being adapted to be rigidly connected to one another such that (i) the tire puncturing members of the modules are pivotal together between the storage positions and the working positions thereof and (ii) the joiner plates remain selectively separable from one another such that the two modules can be separated from one another.

Preferably at least one of the joiner plates includes a pointed end which pivots together with the pointed ends of the tire puncturing members between the storage position below the upper supporting surface and the working position protruding upwardly beyond the upper supporting surface so as to be adapted for puncturing tires.

When the tire puncturing members are evenly spaced apart along the pivot axis from one another by a prescribed spacing, preferably each joiner plate is spaced along the pivot axis from an adjacent one of the tire puncturing members along the same shaft assembly by said prescribed spacing.

Preferably one of the joiner plates includes a socket formed therein and the other joiner plate includes a protrusion formed therein which is arranged to be matingly received within the socket of the joiner plate of the auxiliary module of identical configuration when the joiner plates are rigidly connected.

In one embodiment, the joiner plates of both of the modules is supported longitudinally spaced beyond a corresponding end of the respective main housing such that the joiner plates are supported externally of both of the main housings when the joiner plates are rigidly connected and the main housings of the two modules are longitudinally spaced apart.

In an alternative embodiment, the joiner plate of one of the modules is supported longitudinally spaced beyond a corresponding end of the respective main housing and the joiner plate of another one of the modules is supported recessed inwardly relative to a corresponding end of the respect main housing such that both joiner plates are received within a common one of the main housings when the joiner plates are rigidly connected and the main housings of the two modules are coupled in abutment within one another.

According to another aspect of the invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

at least one counterweight member operatively connected to the tire puncturing members such that the counterweight member is pivotal together with the tire puncturing members between the working position and the stored position;

said at least one counterweight member being angularly offset about the pivot axis relative to the pointed ends of the tire puncturing members and having a mass biasing the tire puncturing members towards the working position under force of gravity alone.

Use of counterweight members for biasing the tire puncturing members into the working position provides a reliable means of rapidly deploying the tire puncturing members which overcomes the high maintenance costs associated with springs which fail under repeated cyclings of the tire puncturing members between working and stored positions thereof.

The one or more counterweight members are preferably supported diametrically opposed from the pointed ends of the tire puncturing members.

The tire puncturing members may be fixed onto a common pivot shaft so as to define a common tire puncturing frame in which the pivot shaft and the tire puncturing members are pivotal together relative to the housing between the working position and the stored position.

Preferably a number of the tire of puncturing members is greater than a number of said at least one counterweight members.

Each counterweight member may include an upper surface which is generally convex so as to extend laterally and opposite to the pointed ends along a downward curve.

Each counterweight member may be mounted on one or more tire puncturing members at a location diametrically opposite from the pointed ends.

The housing may further comprise a threaded aperture receiving a latch bolt threadably therein such that the latch bolt engages the tire puncturing frame in the stored position to retain the tire puncturing frame in the stored position. When the tire puncturing frame further includes a crossbar mounted on the tire puncturing frame in connection between an adjacent pair of the tire puncturing members at a location spaced radially from the pivot axis, the latch bolt preferably engages the crossbar in the stored position.

When the housing comprises a pair of side walls extending in the longitudinal direction along laterally opposing sides of the housing, preferably the pointed ends of the tire puncturing members being located directly adjacent one of the side walls in the stored position thereof.

The traffic control device may further include at least one spring member operatively connected between the tire puncturing frame and the housing to bias the tire puncturing frame towards the working position in addition to the counterweight members. Preferably two springs are supported at longitudinally opposed ends of the tire puncturing frame.

The traffic control device may further include a latching aperture formed in the housing and a latching aperture formed in the tire puncturing frame which are aligned with one another in which the latching apertures receive a common latch pin longitudinally slidable therein in the stored position to retain the tire puncturing frame in the stored position, the latch pin being slidably removable from the latching apertures.

When (i) the tire puncturing members are fixed onto a common pivot shaft such that the pivot shaft and the tire puncturing members are pivotal together relative to the housing between the working position and the stored position and (ii) the pivot shaft is axially slidable relative to the housing through a range of axial positions, preferably a lock member is supported on the pivot shaft so as to fix the pivot shaft relative to the housing at a selected one of the axial positions while enabling pivotal movement of the pivot shaft relative to the housing.

When the housing includes a pair of mounting flanges protruding laterally outwardly from opposing side walls of the housing so as to be adapted to overlap the roadway and the mounting flanges includes fastener apertures for receiving roadway anchors therethrough, preferably at least one guard member is fixed onto a top side of the mounting flanges to protrude upwardly therefrom adjacent each fastener aperture so as to be arranged to at least partially shield a roadway anchor received within the respective fastener aperture.

Furthermore, when the housing includes (i) a pair of mounting flanges protruding laterally outwardly from opposing side walls of the housing so as to be adapted to overlap the roadway and (ii) a top plate extending across a top of the housing so as to define the upper supporting surface of the housing in which the top plate is supported in overlapping relationship overtop of a top side of a corresponding one of the mounting flanges at each side edge of the top plate, preferably at least one guard member is supported on each mounting flange to protrude upwardly therefrom in proximity to the corresponding side edge of the top plate in which the guard member has a ramped upper surface which is slope upwardly towards the top plate.

According to a second aspect of the present invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

the tire puncturing members being joined in fixed relation to one another to define a tire puncturing frame which is collectively pivoted between the working position and the stored position; and an upper stop member supported on the housing so as to engaged by tire puncturing frame in the working position whereby the upper stop member defines an upper limit of pivotal movement of the tire puncturing members relative to the housing;

the upper stop member being formed of resilient material.

The resilient material may be rubber or other comparable materials that are softer than steel. The use of resilient material forming the stop member both reduces noise resulting from the cycling of the tire puncturing members between the working and stored positions thereof, while also reducing some of the jarring impacts of the tire puncturing members being pivoted into the stored or working position in response to passing vehicles so as to increase the longevity of the operating components.

The tire puncturing frame may further include a crossbar mounted on the tire puncturing frame in connection between an adjacent pair of the tire puncturing members at a location spaced radially from the pivot axis, the upper stop member being engaged by the crossbar.

When the housing includes a top plate defining the upper supporting surface of the housing, the upper stop member is preferably fastened to a bottom side of the top plate.

According to a further aspect of the present invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

the tire puncturing members being joined in fixed relation to one another to define a tire puncturing frame which is collectively pivoted between the working position and the stored position; and an upper stop member supported on the housing so as to engaged by tire puncturing frame in the working position whereby the upper stop member defines an upper limit of pivotal movement of the tire puncturing members relative to the housing;

the upper stop member being mounted on the housing so as to be adjustable in height relative to the upper supporting surface.

Providing stop members which are adjustable in elevation enables the traffic control device to be better calibrated at each installation location to ensure an optimal balance between puncturing of tires of vehicles passing over the housing in the wrong direction while not damaging tires or an undercarriage of vehicles passing over the housing in a permissible direction.

The tire puncturing frame may further include a crossbar mounted on the tire puncturing frame in connection between an adjacent pair of the tire puncturing members at a location spaced radially from the pivot axis, the upper stop member being engaged by the crossbar.

When the housing includes a top plate defining the upper supporting surface of the housing, the upper stop member is preferably fastened to a bottom side of the top plate.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
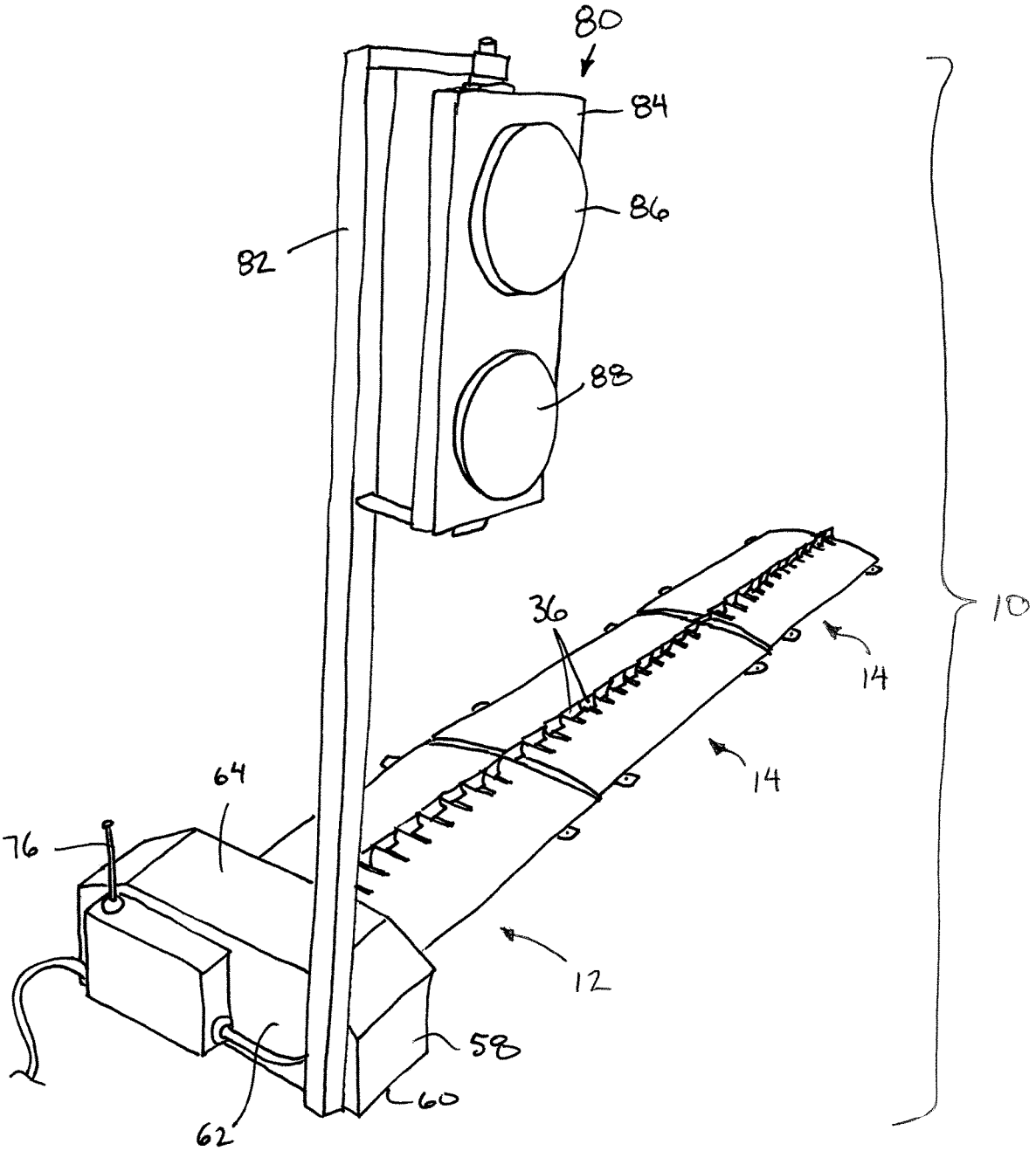
FIG. 1 is perspective view of the traffic control device according to a first embodiment.

Referring to the accompany figures, there is illustrated a traffic control device generally indicated by reference numeral 10. In a deployed configuration, the traffic control device allows safe passage of vehicles across the device in a first direction, while being configured to puncture tires of the vehicle if the vehicle passes over the device in an opposing second direction.

The traffic control device 10 is particularly suited for use with a roadway 12 accommodating vehicular traffic longitudinally in a travel direction of the roadway in which the roadway may be formed of various common roadway materials such as concrete, asphalt, etc.

The traffic control device is elongate in a longitudinal direction and is supported on the roadway such that the longitudinal direction of the device is oriented perpendicularly to the travel direction of the roadway. In some embodiments, the device is fully supported above the road surface of the roadway; however, in other embodiments the device is at least partially recessed relative to the road surface of the roadway that supports the vehicular traffic thereon.

Although various embodiments of the modular traffic control device 10 are shown in the accompanying figures, the features in common with the embodiments of FIGS. 1 to 12 will first be described. In each instance, the traffic control device 10 is generally formed of a plurality of modules including one controller module 12 and a plurality of main modules 14 which are connected in series with one another in the longitudinal direction of the device.

Each main module 14 includes a housing 16 which is elongate in the longitudinal direction between a first end 18 and a second end 20 of the module. A bottom plate 22 of the housing is generally flat and rectangular at the bottom of the housing to span the full length of the module. Two side walls 24 extend upwardly from the bottom plate at laterally opposing sides of the housing such that the sidewalls are parallel and spaced apart from one another, while spanning the full length and the full height of the housing. Two end walls 26 are connected between the sidewalls at the opposing first and second ends of the housing so as to span the full width and the full height of the housing.

Each main module 14 further includes a pair of mounting flanges 28 which are parallel to the bottom plate 22 to extend laterally outwardly from the two side walls 24 respectively. The mounting flanges span the full length of the module and are intended to lie flat against the upper surface of the roadway. Suitable apertures are formed in the mounting flanges to receive anchors therethrough which are typically penetrated into the roadway surface for anchoring the housing relative to the roadway.

A top plate 30 is provided to span the full length of the housing and to span the full width between the side walls 24 of the housing for enclosing the top end of the housing. The top plate 30 is wider than the lateral distance between the sidewalls such that opposing sides of the top plate protrude latterly outward beyond each of the sidewalls for being engaged upon the mounting flanges 28 respectively at opposing side edges of the top plate to provide support to the top plate above the housing. The top plate is also engaged upon the top edges of the side walls 24 to suitably suspend the top plate spanning over the hollow space between the side walls 24. The top plate is sufficiently rigid so as to be self-supporting over the hollow interior of the housing. The top plate defines an upper supporting surface on the top side thereof capable of supporting the weight of vehicles rolling over the device.

Fastener tabs 32 formed of rigid plate material are secured to the side walls 24 so as to lie in parallel abutment against the bottom surface of the top plate 30. Cooperating apertures in the top plate 30 and the fastener tabs 32 enable the top plate to be selectively fastened onto the top side of the housing while permitting the top plate to be removed for accessing the interior of the housing for maintenance and the like.

The connection of the fastener tabs 32 to the side walls 24 of the housing is accomplished using co-operating apertures that receive threaded fasteners so that the fastener tabs are releasably fastened to the side walls 24. In this manner, the fastener tabs 32 can be readily removed and replaced when damaged. For example, if the threaded apertures in the tabs 32 for fastening the top plate 30 become stripped of their threads, or other damage occurs to the tabs due to an impact from road equipment, the tabs can be removed and replaced quickly using conventional tools.

A tire puncturing assembly is supported within the housing in the form of a shaft 34 spanning in the longitudinal direction approximately the length of the housing, and a plurality of tire puncturing members 36 mounted in fixed relation onto the shaft 34. The tire puncturing members 36 are mounted at an even spacing relative to one another in the longitudinal or axial direction by a common prescribed space between each adjacent pair of the members.

The shaft is supported for pivotal movement about a common pivot axis of the tire puncturing members by a plurality of support blocks 35 mounted within the interior of the housing in fixed relation to either the bottom or the sidewalls of the housing. Each support block comprises upper and lower bushing members having cooperating semi-cylindrical recesses formed therein such that the upper and lower bushing members can fully surround the shaft and support the shaft for pivotal movement relative to the housing. A cover member secured by threaded fasteners couples the upper and lower bushing members about the shaft in a manner which enables the bushing members and the shaft to be subsequently released from the housing for maintenance and the like if desired.

Each tire puncturing member 36 is fixed onto the shaft 34 so that the tire puncturing members and the shaft collectively form a unitary frame. Each tire puncturing member is formed of rigid plate material oriented perpendicularly to the longitudinal axis of the shaft. Each of the tire puncturing members extends from the pivot shaft in a common radial direction towards a respective apex of the plate material forming a pointed end 37 at the greatest distance of the plate from the pivot axis. All of the pointed ends 37 or apexes of the tire puncturing members are aligned along a common imaginary line which is parallel to the pivot axis of the shaft.

The top plate 30 includes a plurality of upper openings 38 formed therein, in which each upper opening is an elongated slot oriented generally in a lateral direction, perpendicularly to the longitudinal direction of the housing and the shaft 34. Each upper opening 38 is aligned in the longitudinal direction with a respective one of the tire puncturing members 34 to selectively receive the rigid plate material of the tire puncturing member upwardly through the upper opening 38 in a working position of the device.

More particularly, the tire puncturing members are supported within the housing so as to be pivotal together between a storage position in which the tire puncturing members are fully recessed within the housing below the upper surface of the top plate and the working position in which the pointed ends 37 of the tire puncturing members 36 protrude upwardly from the top plate such that the pointed ends 37 are spaced above the upper surface of the top plate and are suitably oriented for puncturing tires of vehicles travelling over the module in a prescribed direction transverse to the longitudinal direction of the housing.

A plurality of intermediate crossbars 40 are mounted to connect between respective adjacent pairs of the tire puncturing members 36 so as to be parallel to the shaft 34 at a location spaced radially outward therefrom towards the apex of the tire puncturing members. In the storage position of the tire puncturing members with the pointed ends 37 thereof in close proximity to the top plate 30, the crossbars 40 are located near the bottom of the tire puncturing members so as to be spaced below the top plate.

A lower stop 42 is provided within the housing which is arranged to be engaged on the top side thereof by the crossbars 40 in the storage position to prevent further pivoting of the tire puncturing members away from the working position beyond the storage position, but without interfering with upward pivotal movement of the tire puncturing members from the storage position towards the working position.

Similarly, a bottom side of the top plate 30 functions as an upper stop engaged on the bottom surface thereof by the crossbars 40 in the working position to prevent further pivotal movement of the tire puncturing members away from the storage position beyond the working position, but without interfering with downward pivotal movement of the tire puncturing members from the working position towards the storage position.

The shaft 34 of the module extends from a first end 44 to an opposing second end 46 in which the first and second ends of the shaft are located in proximity to the first end 18 and second end 20 of the housing effectively. A joiner plate 48 is mounted at each end of the shaft so as to be adapted for rigid connection to the joiner plates of adjacent modules when several modules are connected in series. Each joiner plate 48 has generally the same perimeter shape as the corresponding tire puncturing members 36 of the module such that each joiner plate is formed of rigid plate material oriented perpendicularly to the shaft to extend radially outward from the shaft towards a respective apex forming a pointed end 50 which is aligned along the same imaginary line that is aligned with the pointed ends 37 of the tire puncturing members 36.

The joiner plates 48 differ from the tire puncturing members 36 by being reduced in thickness in the axial direction of the shaft relative to the tire puncturing members such that a thickness of each joiner plate is approximately half a thickness of the tire puncturing members. In this manner, when two joiner plates 48 of adjacent modular sections are rigidly coupled together in close abutment alongside one another, a combined thickness of the two joiner plates in the axial direction is approximately equal to the thickness of a single tire puncturing member 36 in the axial direction.

Figure 2:
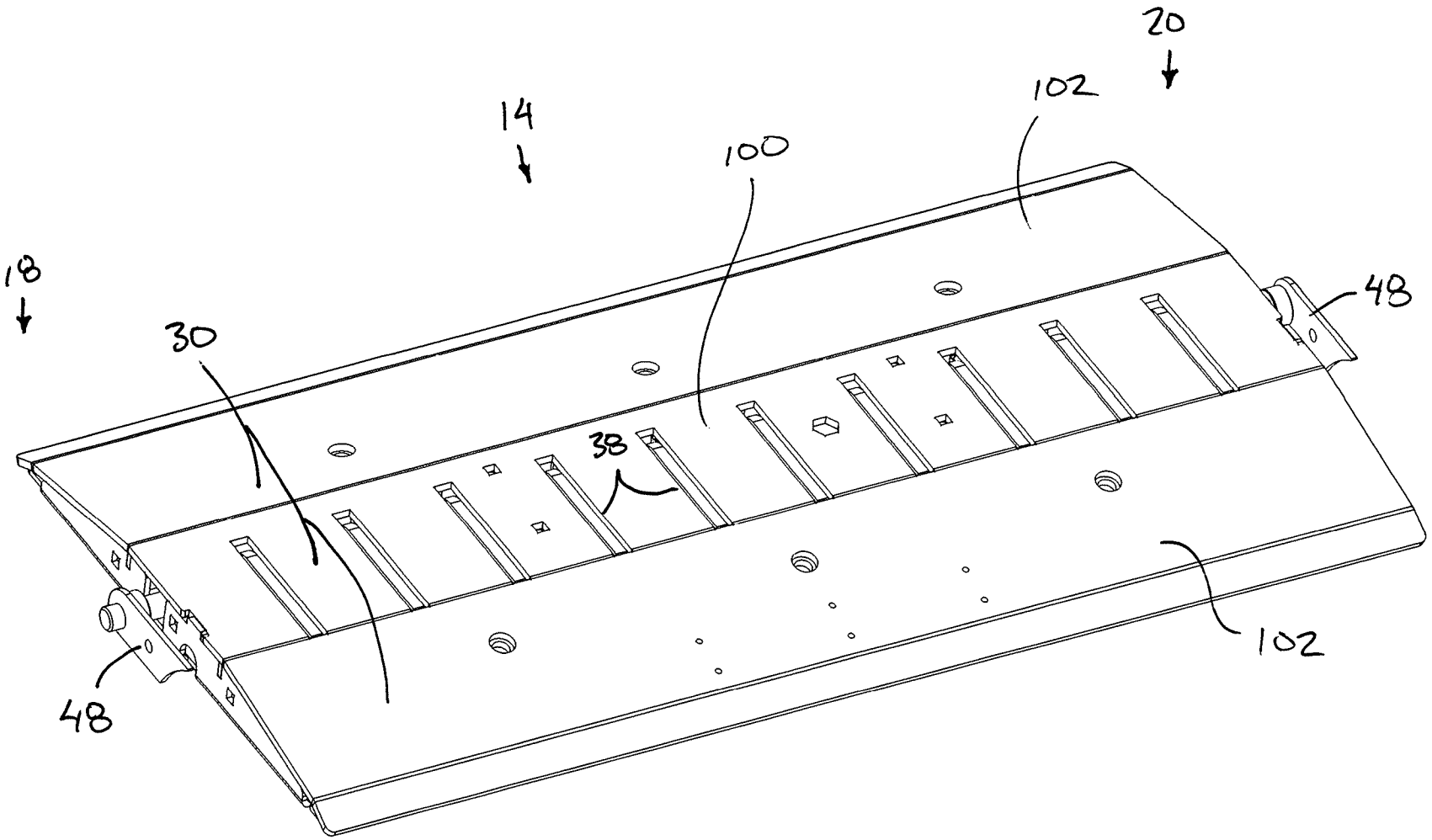
FIG. 2 is a perspective view of one of the modules of the device according to the first embodiment of FIG. 1.
Figure 3:
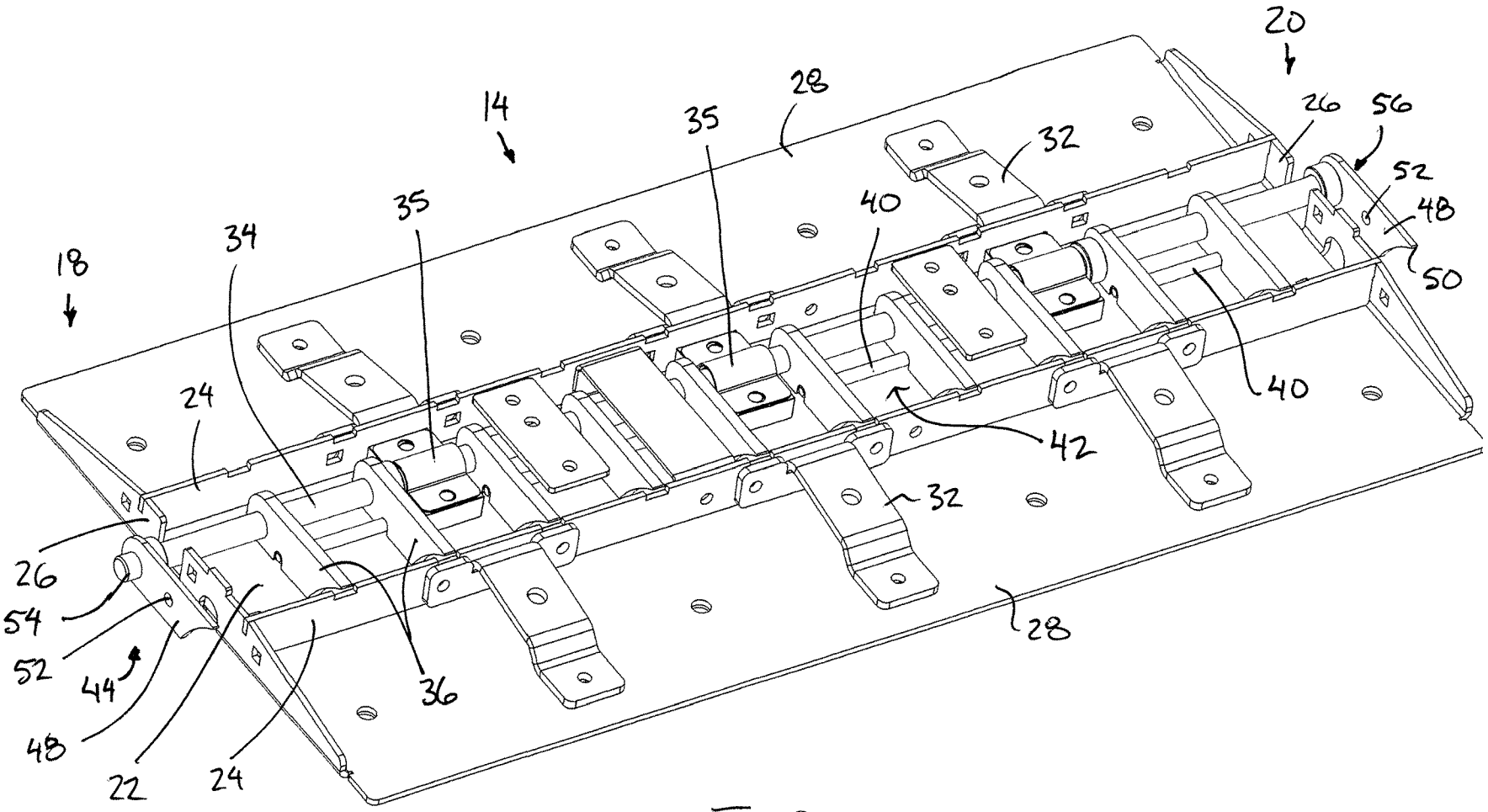
FIGS. 3 and 4 are additional perspective views of one of the modules of the device according to the first embodiment of FIG. 1 with the cover shown removed for illustrative purposes.
Figure 4:
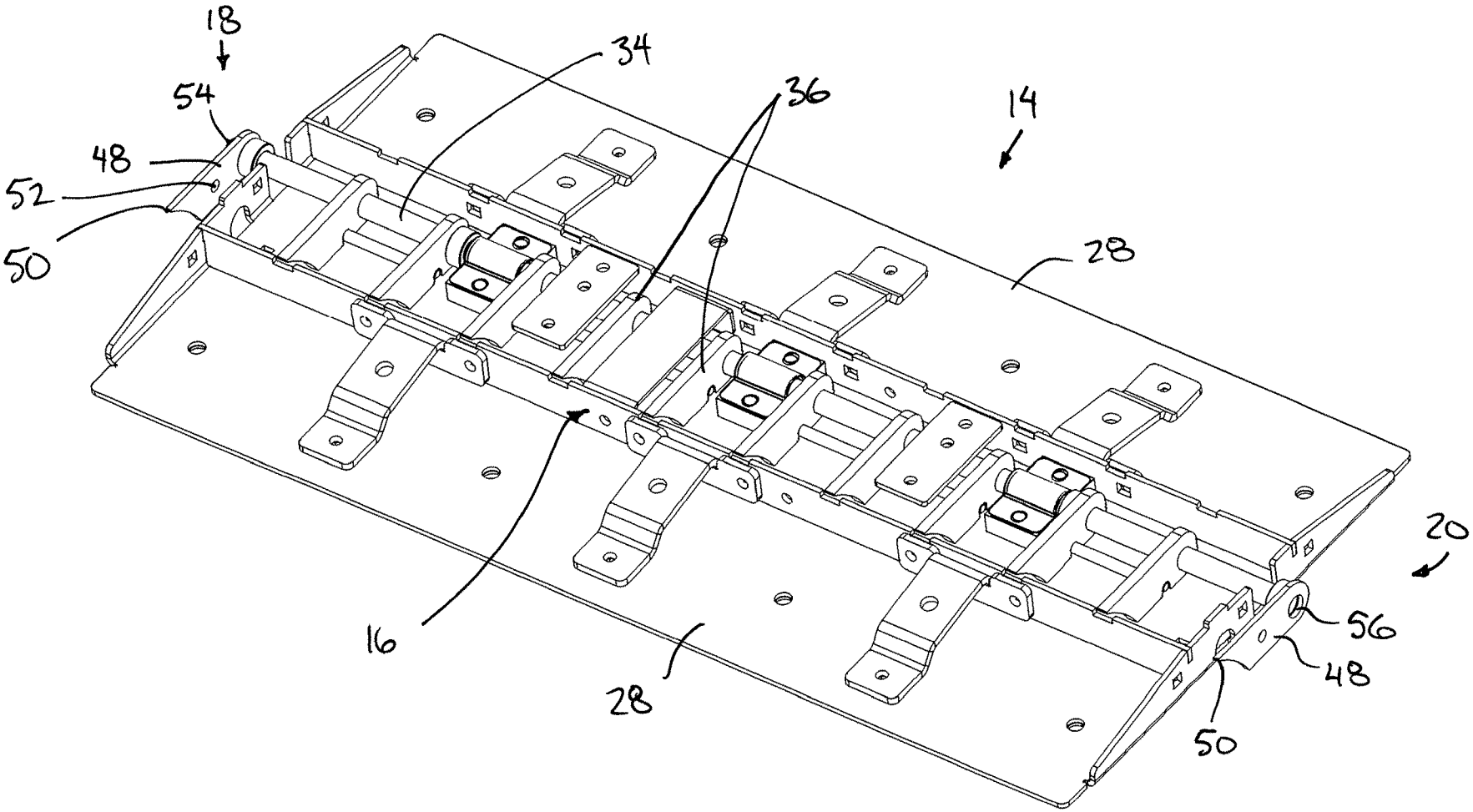
Figure 5:
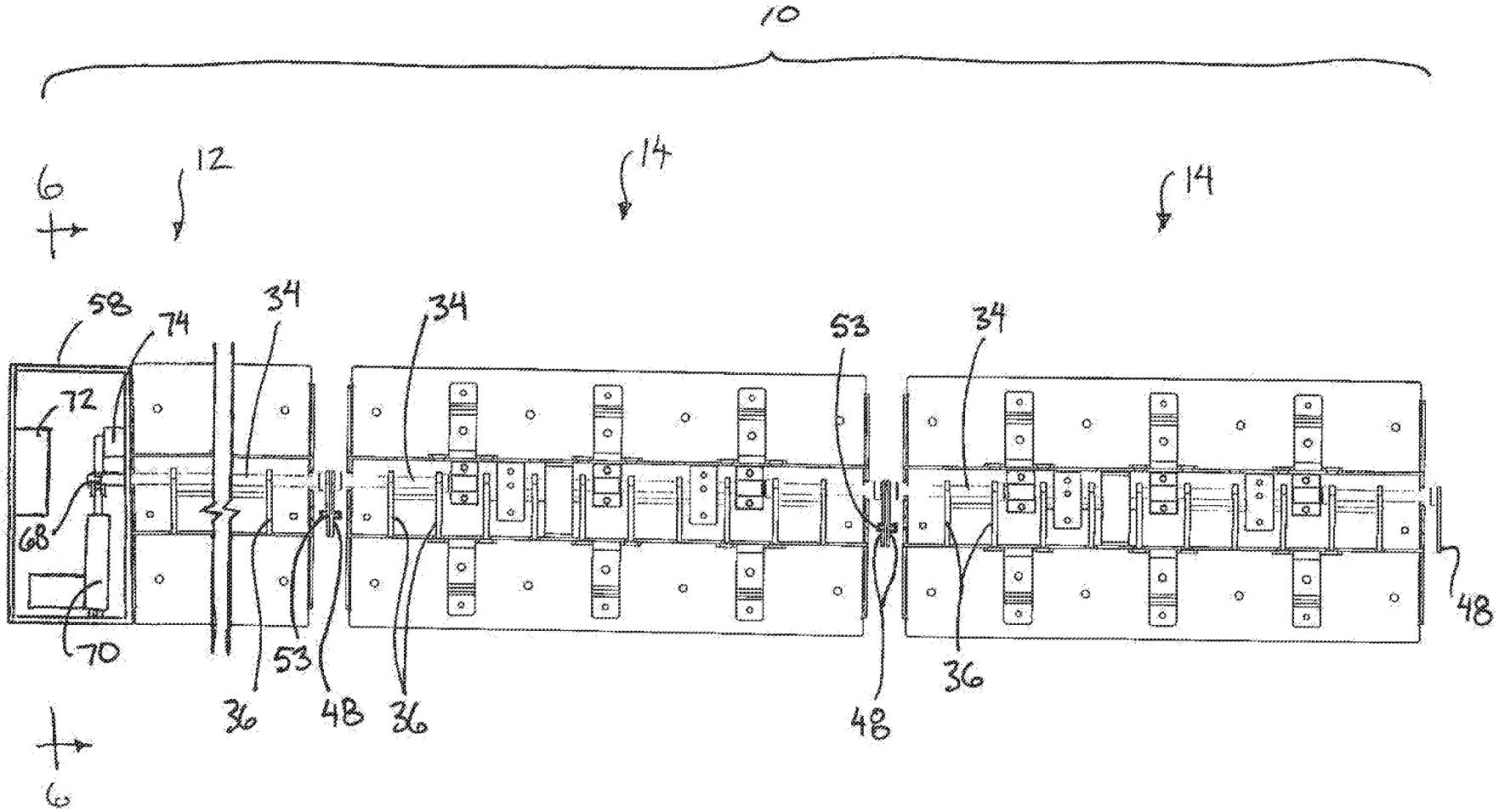
FIG. 5 is a top plan view of the device according to the first embodiment of FIG. 1 with the covers of the modules shown removed.
Figure 6:
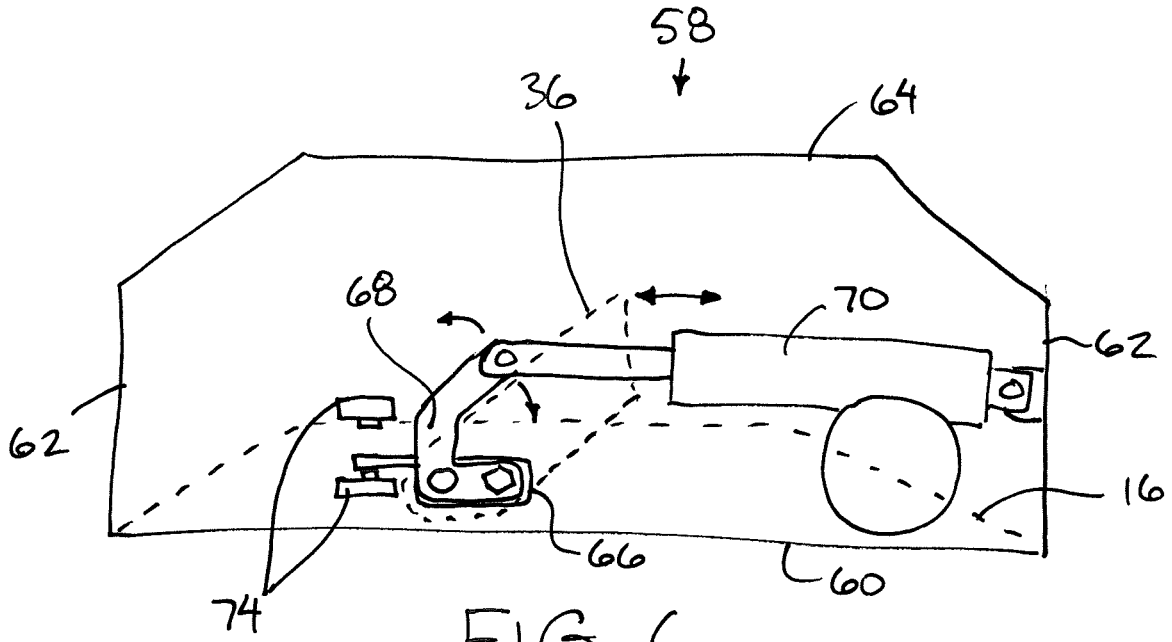
FIG. 6 is a sectional view along the line 6-6 in FIG. 5 illustrating the actuator linkage.
Figure 7:
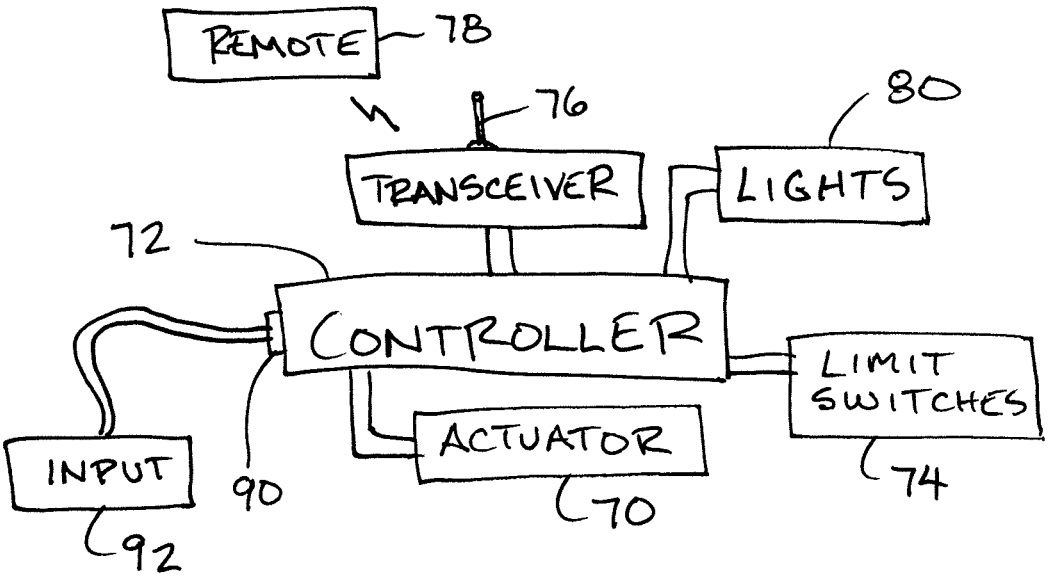
FIG. 7 is a schematic representation of the controller of the modular traffic control device according to all embodiments.
Figure 8:
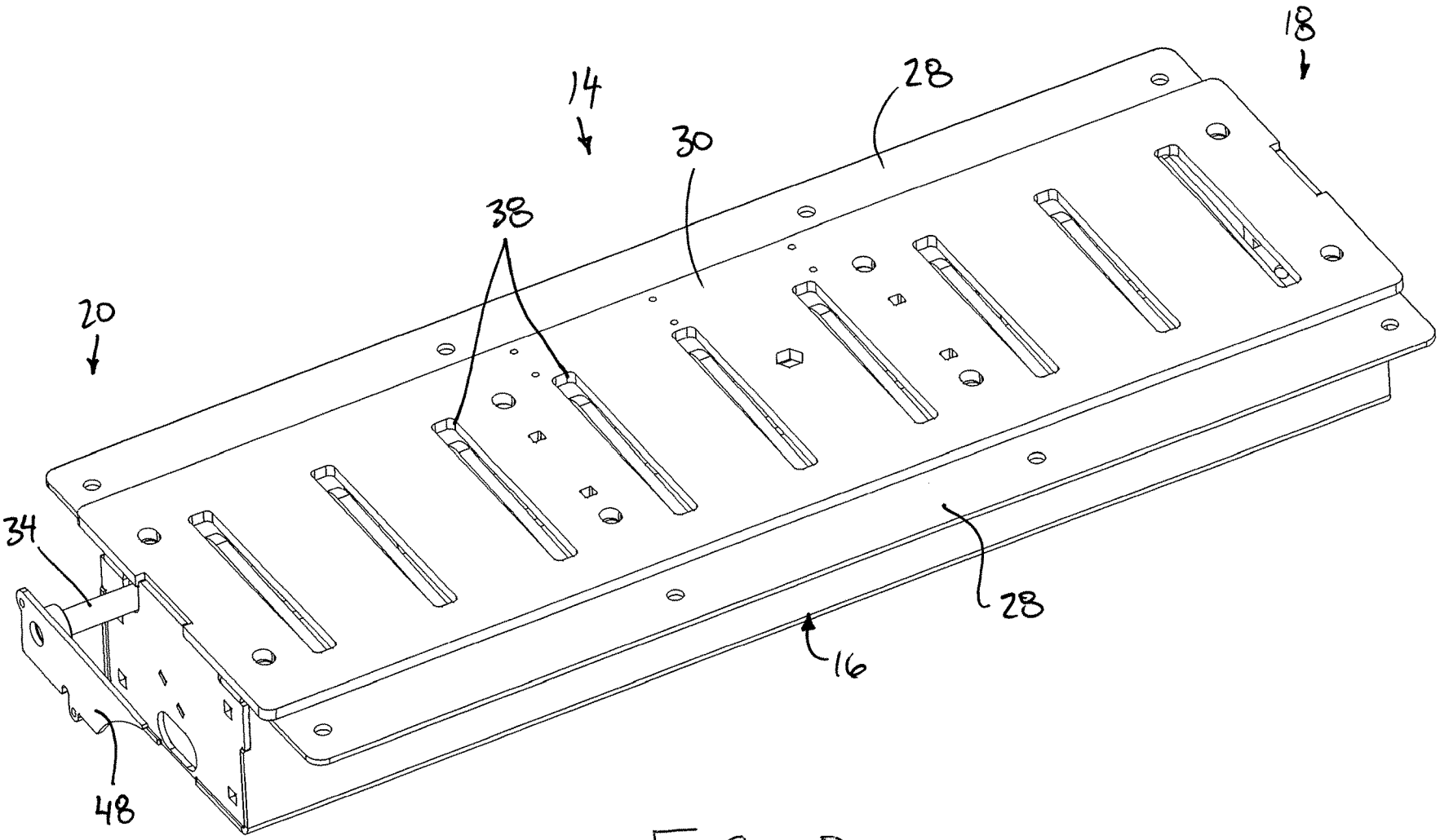
FIG. 8 is a perspective view of one of the modules of the modular traffic control device according to a second embodiment.
Figure 9:
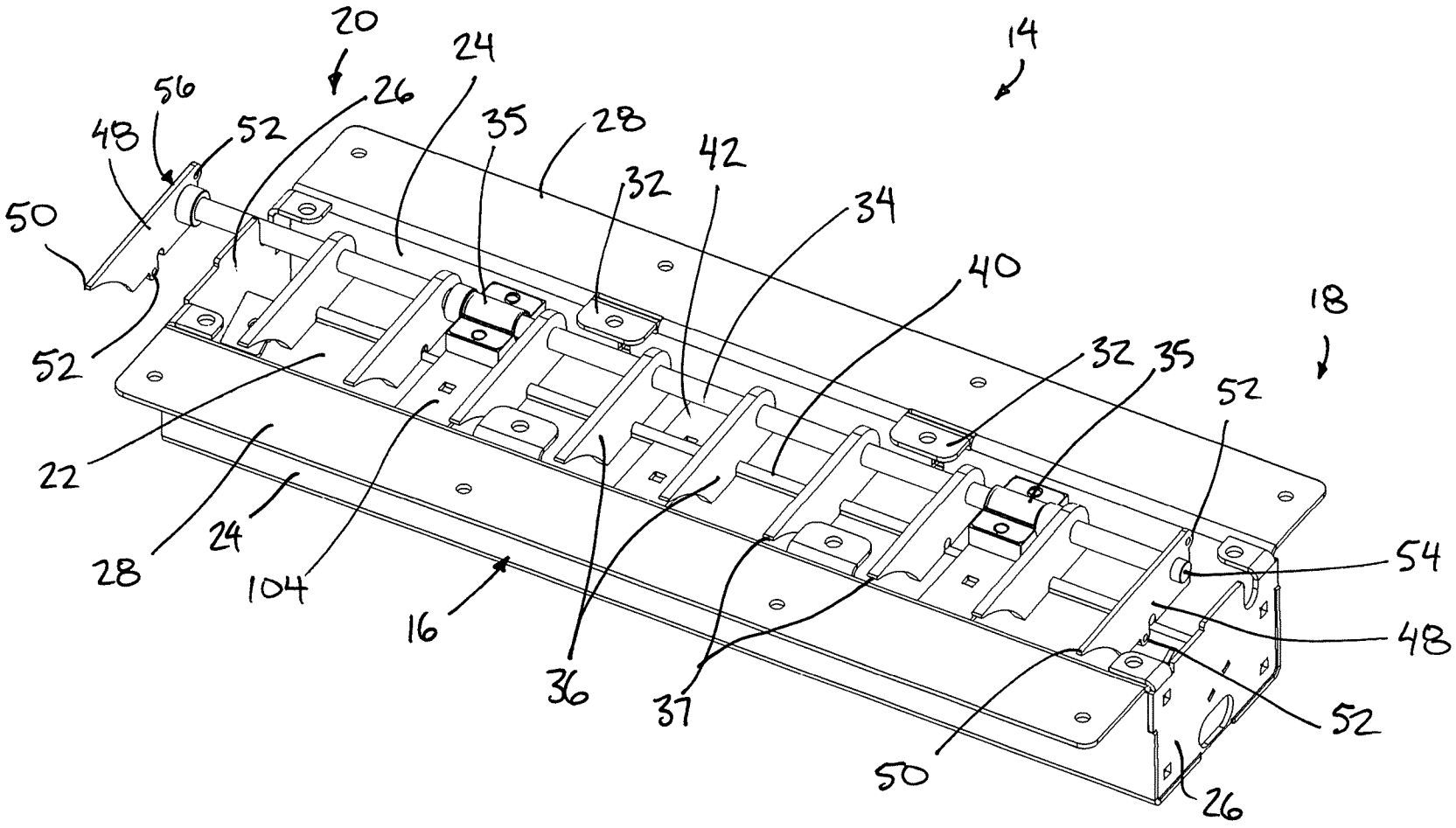
FIG. 9 is a perspective view of the module according to the second embodiment of FIG. 8 shown with the cover removed for illustrative purposes.
Figure 10:
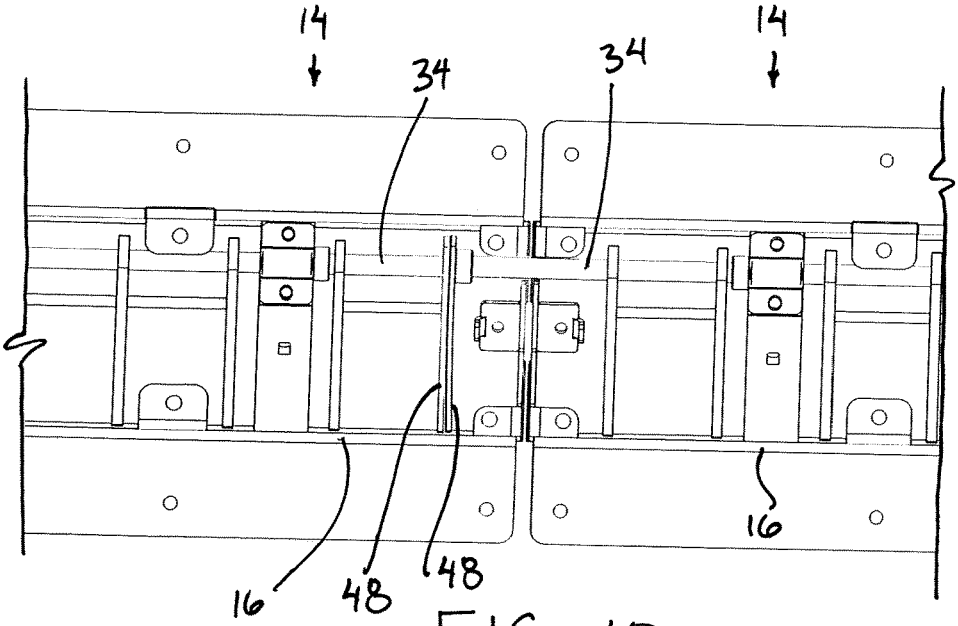
FIG. 10 is a top plan view of two modules connected in series in the modular traffic control device according to the second embodiment of FIG. 8.
Figure 11:
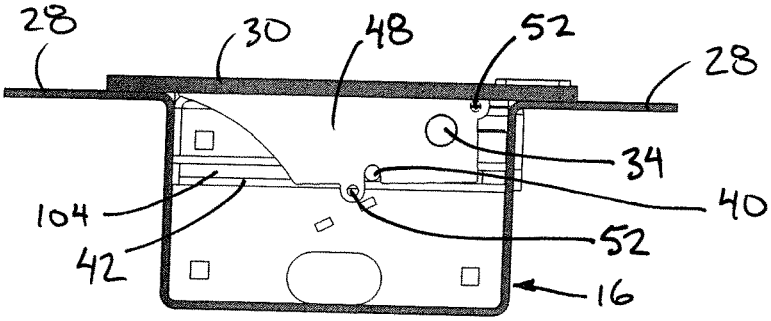
FIG. 11 is a sectional view along the line 11-11 in FIG. 10.
Figure 12:
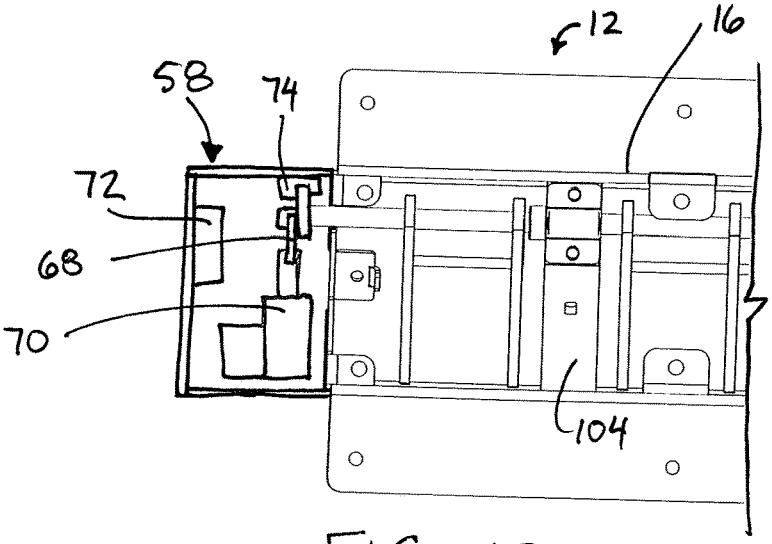
FIG. 12 is a top plan view of a control module of the modular traffic control device according to the second embodiment of FIG. 8.

Each joiner plate includes at least one fastener aperture 52 therein such that the fastener apertures of two joiner plates are aligned with one another when two identical modules are abutted in series with one another to receive fasteners therethrough spaced radially from the shaft and the pivot axis of the shaft to rigidly couple the joiner plates at a location spaced radially from the shaft as shown in FIGS. 2 to 4. Each joiner plate 48 is a flat plate fixed onto the corresponding end of the shaft to rotate with the shaft so that the shafts of the adjacent modules are pivotal together between storage and working positions of the tire puncturing members when the joiner plates are rigidly coupled by fasteners 53 extending through the apertures 52 in the joiner plates. The flat joiner plates that are perpendicular to the shaft are directly abutted against one another when mounted according to FIG. 5, and the apertures 52 extend through the joiner plates in a direction parallel to the common pivot axis of the frame as shown in FIGS. 2 to 4. Accordingly, the fasteners 53 received in the apertures 52 for coupling the joiner plates also lie parallel to the common pivot axis of the tire puncturing frame at a location spaced from the shaft.

To assist in coaxial alignment of the shafts of two adjacent modules, the first end 44 of each shaft is provided with a protrusion 54 in the form of a cylindrical boss which is coaxially aligned with the shaft. The second end 46 of each shaft is provided with a corresponding socket 56 which closely receives the protrusion 54 therein. The socket 56 is accordingly also coaxially aligned with the shaft. The cooperation of two connection points including the protrusion received within the socket, and a fastener secured through cooperating apertures at a location radially offset from the socket and protrusion enables two joiner plates of adjacent modules to be securely fixed relative to one another with accurate angular positioning of the adjacent shafts relative to one another. This ensures the pointed ends 37 of the tire puncturing members of two adjacent modules are substantially aligned along a common imaginary line relative to one another.

In addition, the fastening of the two joiner plates together effectively defines another tire puncturing member at the junction between the adjacent modules. Each joiner plate is spaced in the axial direction from the outermost and closest tire puncturing member along the same shaft by approximately the same prescribed spacing between each adjacent pair of the tire puncturing members. Accordingly, when two adjacent modules are coupled together, the joined pair of joiner plates forms an assembled tire puncturing member which is located at an even spacing with all of the other tire puncturing members of the two coupled shafts along a common row of tire puncturing members.

The main module typically has an overall length which is approximately 48 inches so as to be suitable for being received on a standard shipping pallet. With the tire puncturing members retracted into the storage position, the low profile of the housing readily permits multiple modules to be stacked together on a common pallet for shipping.

The controller module 12 shown in the accompanying figures, is substantially identical in configuration to the main module 14 with the exception of having fewer tire puncturing members along a shorter shaft but at the same prescribed spacing between the tire puncturing members resulting in the overall length of the main housing in the longitudinal direction of the controller module being shorter than the main housing of the main module 14. The controller module further includes a controller housing 58 which is mounted at one end of the main housing 16 such that the end of the shaft in proximity to the opposing end of the main housing locates a joiner plate 48 thereon. The joiner plate serves to couple that end of the housing that is opposite to the controller housing 58 to the corresponding end of an adjacent main module 12 similar to the coupling of joiner plates between two adjacent main modules as described above.

More particularly, the controller housing 58 is an enclosed box including a bottom plate 60, side plates 62 extending upwardly about a perimeter of the bottom plate, and a removable cover 64 enclosing the top side of the housing. The housing may be near or slightly greater in lateral width than the overall width of the main housing including the mounting flanges 28 protruding therefrom while being much shorter in length in the longitudinal direction or axial direction of the shaft. For example, in a preferred embodiment, the main housing 16 of the controller module is approximately 38 inches in length and the controller housing 58 has a length of approximately 10 inches such that the combined length of the controller housing and main housing of the control module which define the overall length of the control module is approximately 48 inches so as to be substantially identical to the overall length of a main module 14 described above. The controller module 12 is thus also well-suited for stacking on a standard shipping pallet.

In the controller module, the end of the shaft closest to the controller housing and opposite from the joiner plate 48 protrudes from the main housing into the controller housing 58 for connection to a suitable actuator linkage which drives pivotal movement of the shaft between the storage position and the working position thereof. The actuator linkage includes a crank arm 66 fixed on the end of the shaft to protrude radially outward therefrom with a fastener aperture therein to form a fastening connection to a link arm 68 also oriented to extend generally radially outward from the shaft. A fastener aperture in the link arm 68 at a location offset from the pivot axis forms a pivotal coupling with one end of a linear actuator 70 supported within the controller housing 58. The opposing end of the linear actuator 70 is pivotally anchored within the controller housing 58. The pivotal connections at opposing ends of the linear actuator are pivotal about respective axes oriented parallel to the pivot axis of the shaft 34. Linear extension and retraction of the actuator 70 causes the link arm 68 and the shaft coupled thereto to be pivoted together about the pivot axis of the shaft which in turn pivots all of the tire puncturing members mounted on the shaft between the storage and working positions thereof. The fastened connection between the link arm 68 and the crank arm 66 enables the actuator linkage to be disconnected from the shaft if desired. In this manner, the tire puncturing members can be disconnected from the actuator and manually displaced into the storage or working positions as may be desired. Locking pins may be used to secure the tire puncturing members in either position in this instance.

The electrical controller 72 is also supported within the controller housing 58 forming a wired connection to the linear actuator 70 to control actuation thereof. The electrical controller may receive power from a battery also supported within the controller housing, or may be connected to an external power source through suitable wiring communicating externally of the controller housing 58.

Limit switches 74 are also located within the controller housing which may be either included as switches that are contacted at the end of travel of the stroke of the linear actuator 70 or that are contacted by a suitable trigger forming part of the actuating linkage for actuating respective limit switches when the tire puncturing members reach the working position and/or storage positions thereof. More particularly the limit switches 74 communicate with the electrical controller 72 to generate an upper limit signal to the controller when the working position is reached and to generate a lower limit signal delivered to the controller when the storage position is reached. The controller 72 uses the signals as inputs to control actuation of the actuator as described in the following.

The controller 72 also includes a transceiver connected to a suitable antenna 76 externally supported on the controller housing 58 for communication of the controller 72 with a wireless remote 78 having various buttons thereon which can be actuated by an operator to generate operator commands delivered to the electrical controller for controlling the function of the traffic control device.

An indicator assembly is also provided on the controller housing for indicating the operating position of the device. The indicating assembly includes a rigid pole 82 fixed on the controller housing 58 to extend upwardly therefrom and support an indicator housing 84 at the top end thereof. The indicator housing supports a first indicator light 86 for visually indicating when the device is in the working position when it is activated and a second indicator light 88 for visually indicating when the device is in the storage position when it is activated. In a preferred embodiment, the first indicator light 86 is a red light at the second indicator light 88 is a green light.

A socket 90 is provided on the controller housing 58 in communication with the controller to allow an optional wired connection to an external operator input device 92 with suitable buttons to accept operator commands and generate command signals to control operation of the device as described herein.

In use, the traffic control device 10 is typically assembled by connecting one controller module 12 together with one or more main modules 14 connected in series with one another in the longitudinal direction of the modules. At the junction between each adjacent pair of modules, the corresponding joiner plates 48 are aligned with one another such that the protrusion of one plate is received within the socket of the other plate and one or more fasteners are secured through cooperating apertures at radially offset locations from the pivot axis so that the joiner plates are coupled in fixed relation to one another at a precise angular orientation relative to one another corresponding to alignment of the tire puncturing members. The fastened joiner plates define an additional tire puncturing member at the junction between two modules which is substantially evenly spaced apart relative to all the other tire puncturing members within a common row of tire puncturing members.

When the operator generates suitable operator commands using a wireless remote 78 or a wired input device 92, the controller actuates the linear actuator to displace the tire puncturing members collectively into the storage position or the working position thereof until the corresponding limit switches are triggered to stop further actuation of the linear actuator. Subsequent actuation of the actuator will reverse until the corresponding other limit switch is triggered to stop the movement thereof. In each position, the indicator assembly 80 responds by activating the appropriate indicator light to indicate the operating position of the tire puncturing members. The limit switches may be used as inputs for determining the position of the tire puncturing members and thus the actuation of the appropriate indicator lights.

Turning now more particularly to the first embodiment shown in FIGS. 1 through 7, in this instance each of the modules is adapted for mounting fully above the road surface of a roadway. Accordingly in this instance, the mounting flanges 28 are located at the bottom side of the housing integrally with the bottom plate of the housing. Furthermore the top plate in this instance spans substantially the combined full width of the housing and the mounting flanges and includes a center section 100 spanning horizontally between the two sidewalls of the housing and two ramp sections 102 extending at a downward and laterally outward slope from the top of a respective one of the sidewalls to the outer free edge of a respective one of the mounting flanges. The fastener tabs 32 in this instance protrude outwardly from the sidewalls at a slope corresponding to the slope of the ramp sections 102 for fastening of the ramp sections of the top plate to the fastener tabs to secure the top plate to the housing.

When mounting fully above the road surface, the resulting housing is low in profile such that the support blocks 35 this instance are supported directly on the bottom plate of the housing. Furthermore, the bottom plate of the housing functions as the lower stop 42 against which the intermediate crossbars 40 are engaged in the storage position.

In order to also maintain the low profile of the tire puncturing members, only a single fastener aperture is provided within each joiner plate at a location spaced radially outward from the pivot axis which is sufficient to rigidly fix the joiner plates together when coupled and used in cooperation with a protrusion and socket at the pivot axis location.

The device 10 according to the first embodiment also differs from the second embodiment in that both ends of the shaft protrude longitudinally outward beyond the corresponding ends of the main housing 16 such that the joiner plates 48 are located externally of the housing at both ends of the housing in the main module 14. The joiner plate at one end of the controller module 12 is similarly located externally of the housing. In this instance, when rigidly coupling the joiner plates of two adjacent modules according to the first embodiment, the modules remain spaced apart from one another by approximately the prescribed spacing between each adjacent pair of tire puncturing members. The coupled pair of joiner plates at the junction between two modules thus defines an assembled tire puncturing member which is longitudinally centered between the main housings of the two modules. This is achieved by the shaft at each end of the main housing protruding from the housing by a distance which is approximately equal to half of the prescribed space between adjacent tire puncturing members.

Finally, the first embodiment differs from the second embodiment by locating the controller housing in the control module at the first end of the main housing as opposed to being located at the second end of the main housing in the second embodiment.

Turning now to the second embodiment shown in FIGS. 7 through 12, in this instance the modules are intended to be supported such that the main housings thereof are at least partially recessed relative to the upper road surface of the roadway so as to be partially embedded into the roadway. The mounting flange 28 in this instance is accordingly located at the top side of the housing to protrude laterally outwardly from the top edges of the two sidewalls of the housing. The top plate in this instance comprises a single flat section which is mounted to span between the sidewalls and overlap in parallel arrangement at opposing side edges on the top surface of the two mounting flanges respectively. The fastener tabs 32 in this instance protrude inwardly from the respective sidewalls so as to be located internally within the housing.

When recessing the housing into the roadway, the height of the housing can be increased to locate the tire puncturing members in the upper portion of the housing while the lower portion of the housing functions as a sump below the operating components to protect the operating components. In this instance housing crossbars 104 are supported in fixed relation to the sidewalls to span laterally between the sidewalls at a location spaced above the bottom plate of the housing for supporting the support blocks 35 thereon which in turn supports the shaft and the tire puncturing members supported thereon spaced above the bottom of the housing.

In the second embodiment, a portion of each rigid plate forming a tire puncturing member may also protrude from the shaft diametrically opposite from the apex defining the pointed end 37 so as to locate an additional fastener aperture 52 therein. Each joiner plate may thus include two fastener apertures at diametrically opposed sides of the shaft to ensure a more rigid connection between adjacent shafts of adjacent modules.

In the second embodiment, the first end of the shaft in each main housing is recessed inwardly relative to the corresponding end of the housing by a distance corresponding approximately to half of the longitudinal spacing between adjacent tire puncturing members. At the opposing second end, the shaft protrudes outwardly from the corresponding end of the housing by a distance again corresponding approximately to half of the longitudinal spacing between adjacent tire puncturing members. A suitable aperture is provided in the end wall of the housing at the first end thereof to receive the shaft of an adjacent module extending therethrough such that the joiner plates of two adjacent modules can be coupled together to form an assembled tire puncturing member wholly contained within the interior of one of the housings while the housings are coupled in abutment with one another using fasteners coupled through the end walls of the housings for example.

In the second embodiment, a controller module may be used together with main modules as described above, or an independent controller housing may be provided in connection at one end of an outermost one of the main modules connected in series. In this instance, the independent controller housing is coupled to one end of the shaft so as to be actuated in substantially the same manner using similar components as the controller housing 58 described above.

In either of the first or second embodiments, displacement of the tire puncturing members between the working position and the storage position thereof can be accomplished using an actuator as described above, or may be accomplished by removing the cover of the controller housing to manually displace the actuator linkage between the working and storage positions followed by use of locking pins to retain the actuator linkage in the selected position of the tire puncturing members.

Figure 13:
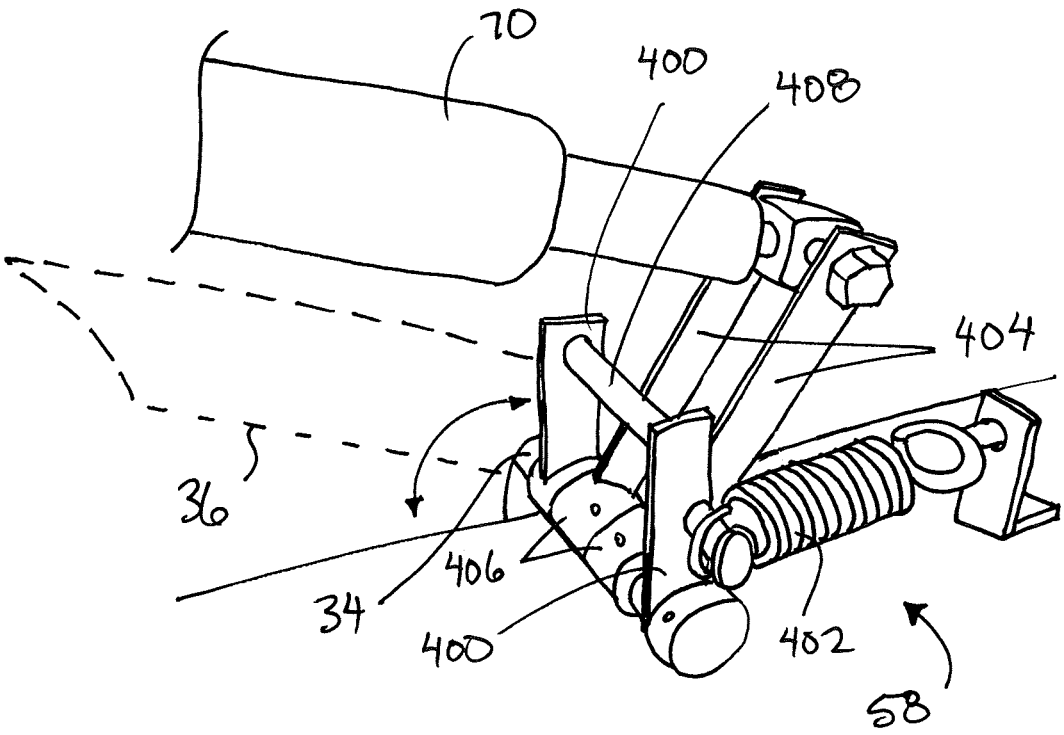
FIG. 13 is a perspective view of an alternate arrangement for controlling displacement of the tire puncturing members between the stored and working positions.

Turning now to FIG. 13, according to a further embodiment of the device 10, the controller housing 58 may be modified to include the following linkage for operating the tire puncturing members 36 between the stored and working position thereof. The end of the shaft 34 again protrudes from the main housing 16 into the controller housing 58, however in this instance two crank arms 400 are fixed to the shaft to extend radially outward from the shaft in a common radial direction. A crossbar 408 is connected in fixed relation between the crank arms 400, parallel to the shaft 34 at a location spaced radially outward from the shaft 34. A spring 402 is operatively connected between the housing 58 and one of the crank arms for biasing the crank arms, and in turn biasing the shaft 34 supporting the tire puncturing members 36 thereon, towards the working position of the tire puncturing members.

An actuating arm 404 formed of two parallel plates are supported on collars 406 that freely rotate on the shaft at an intermediate location between the two crank arms 400 such that the actuating arm extends radially outward from the shaft beyond the crossbar 408 that is connected between the two crank arms 400.

The actuator 70 in this instance is connected to the actuator arm 404 for displacing the actuator arm between a first position and a second position. In the first position, the actuator arm 404 is in non-interfering relationship with the crank arms 400 as they are displaced through a full range between the stored and working positions of the tire puncturing member. In the second position, the actuator arm 404 engages the crossbar of the crank arms and forces the crank arms towards the stored position of the tire puncturing members 36. Accordingly, in the first position of the actuator and the actuator arm 404, the crank arms 400 and the crossbar 408 connected therebetween can freely pivot between the stored and working positions of the tire puncturing members while being biased towards the working position by the spring 402. In the second position of the actuator, the actuator arm is displaced into engagement with the crossbar 408 of the crank arms 400 so as to force the crank arms into the stored position and maintain the tire puncturing members stored within the housing 16. In this manner, the traffic control device 10 can be operated in a first mode in which the tire puncturing members are freely pivotal but biased towards the working position, and in a second mode in which the tire puncturing members are fixed in the stored position under control of the actuator.

Turning out to the embodiment of FIG. 14, the system according to FIG. 13 may be further modified such that the biasing is provided by a counterweight 410 mounted on the tire puncturing members diametrically opposite from the pointed apex thereof as described in further detail in the following embodiments. In yet further embodiments, the biasing may be provided by a cushion member 412 which is mounted below the tire puncturing members towards the apex thereof such that returning the tire puncturing members towards the stored position thereof requires the cushion member to be compressed. The cushion member however is biased towards an uncompressed position which in turn biases the tire puncturing members to return to the working position. The cushion member may be any type of pillow, air cushion, hydraulic cylinder, airbag and the like which is commonly employed in various applications, for example in airspring suspensions or airspring brakes of conventional highway truck tractors.

Figure 14:
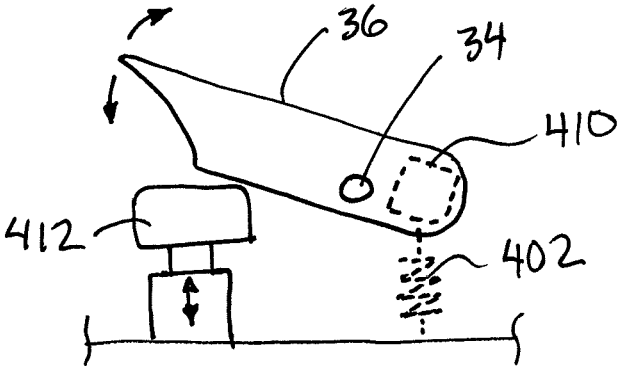
FIG. 14 is a schematic representation of further alternate arrangements for controlling displacement of the tire puncturing members between the stored and working positions.

These additional biasing systems shown in FIG. 14 may be operated in cooperation with a controller according to the embodiment of FIG. 13. In this instance, the controller is operated by a biasing system inside the control box and the actuator inside the control box can be used to override the independent movement of the spring-loaded or counterweighted controller arm that keeps the tire puncturing members in the working and armed position thereof.

In yet further embodiments, the cushion member 412, the counterweight 410, or the spring 402 may be used individually or in cooperation with one another as the primary means of operating the tire puncturing members between the stored and working positions thereof. In this instance the traffic control devices typically provided with some form of manual override to manually force into and retain the tire puncturing members in the stored position thereof. For example, in some embodiments, the cushion member 412 may be used only to dampen the downward movement of the tire puncturing members as the tire puncturing members are rapidly pivoted towards the stored position resulting from impacts of a vehicle passing over the device, while the biasing to return the tire puncturing members to the working position is accomplished by counterweights or springs for example.

Figure 15:
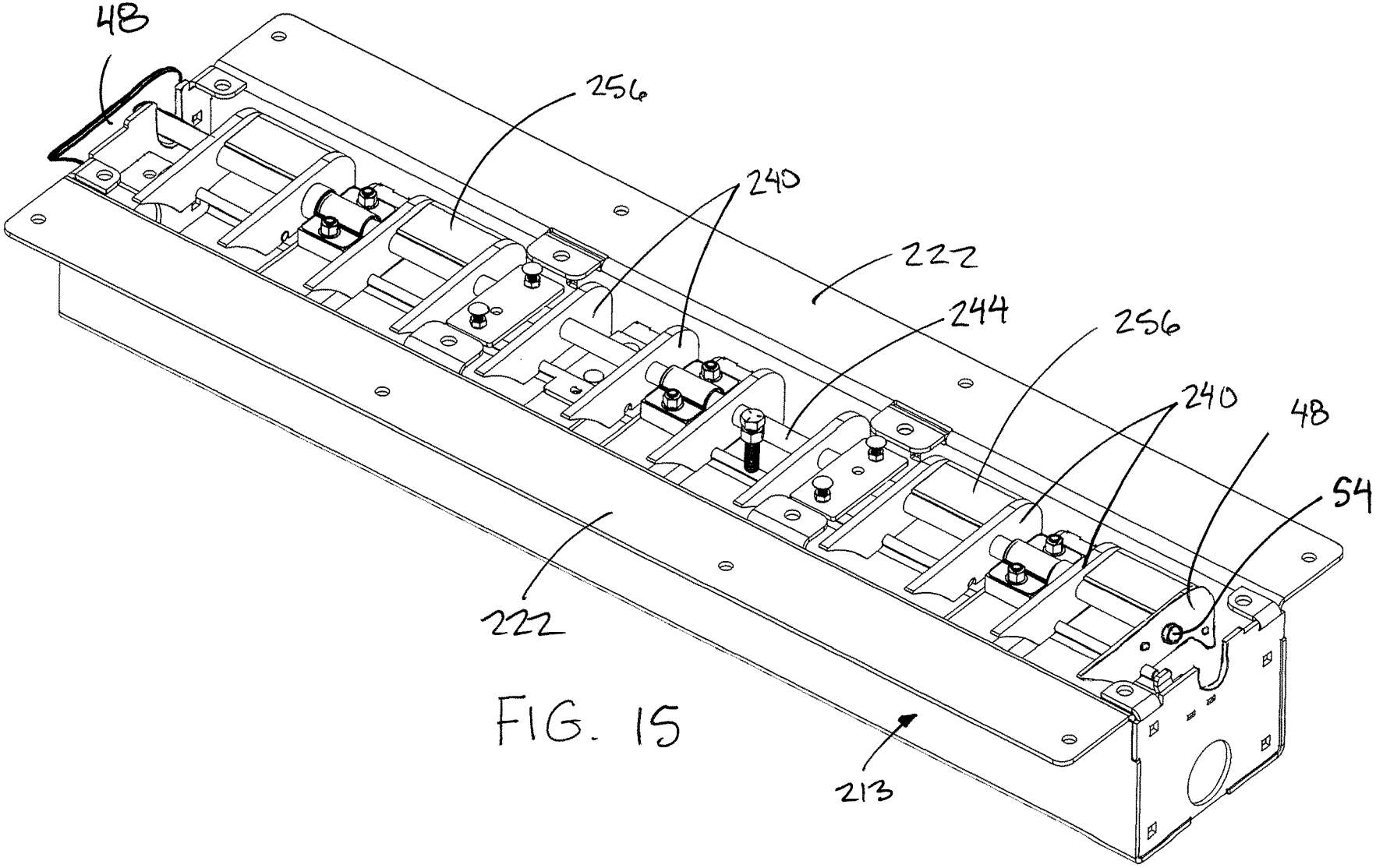
FIG. 15 is another embodiment of the traffic control device which can be modularly connected to adjacent devices, and which includes counterbalance weights for biasing the tire puncturing members into the working position thereof.
Figure 16:
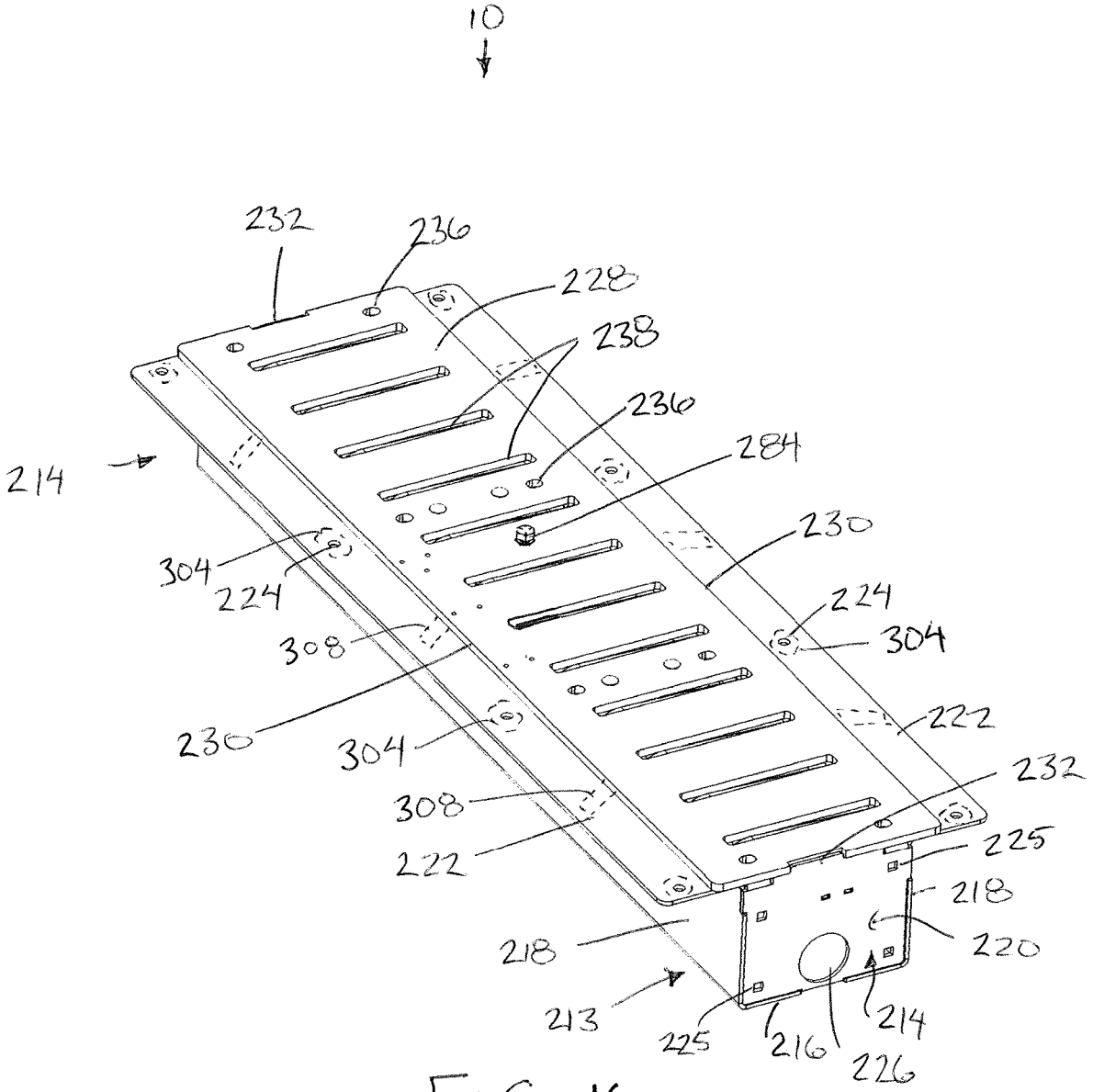
FIG. 16 is perspective view of the traffic control device.
Figure 17:
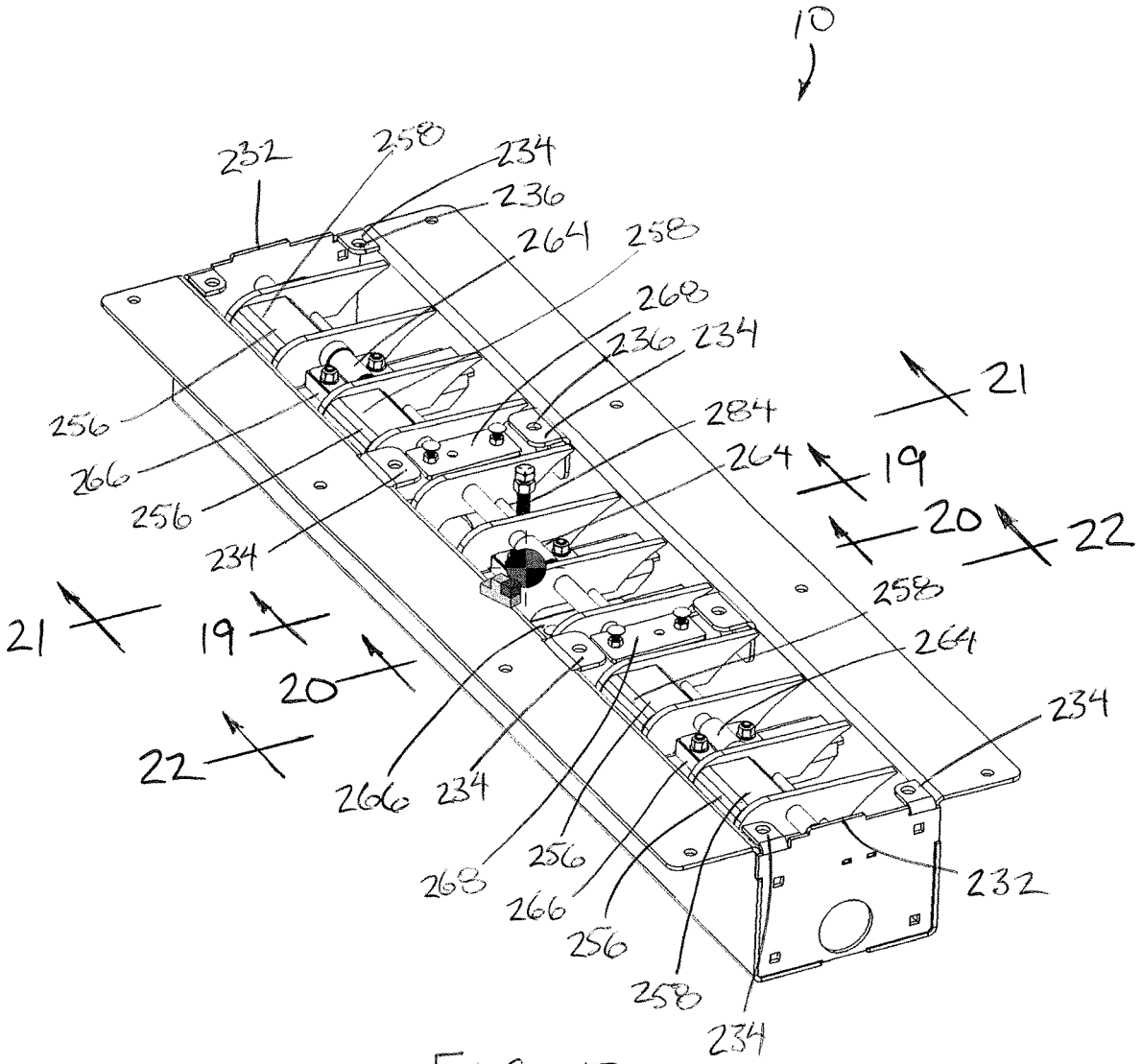
FIG. 17 is a perspective view of the traffic control device with the top plate removed.
Figure 18:
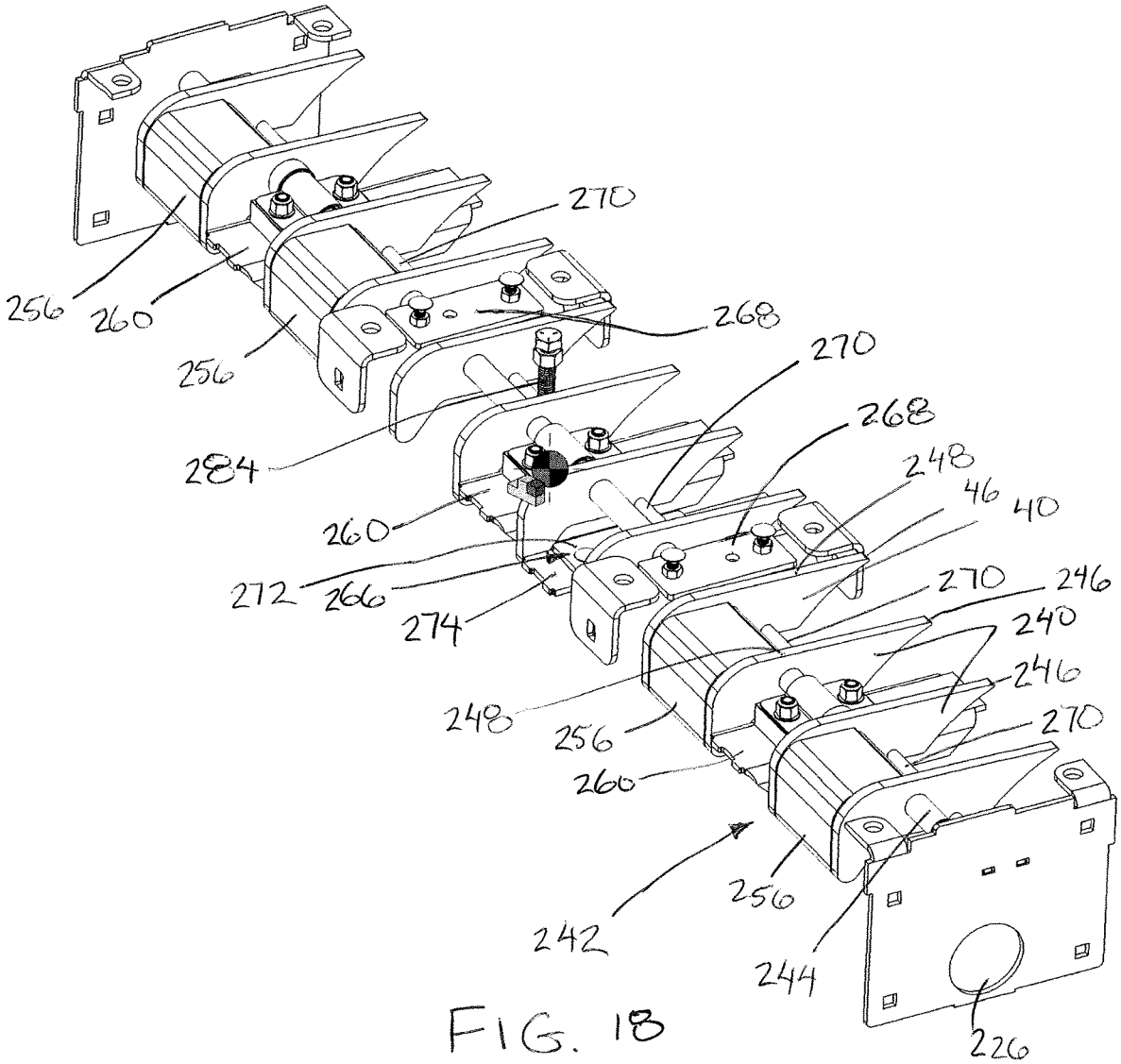
FIG. 18 is a perspective view of the traffic control device with the top plate and the lower housing removed for illustrative purposes.
Figure 19:
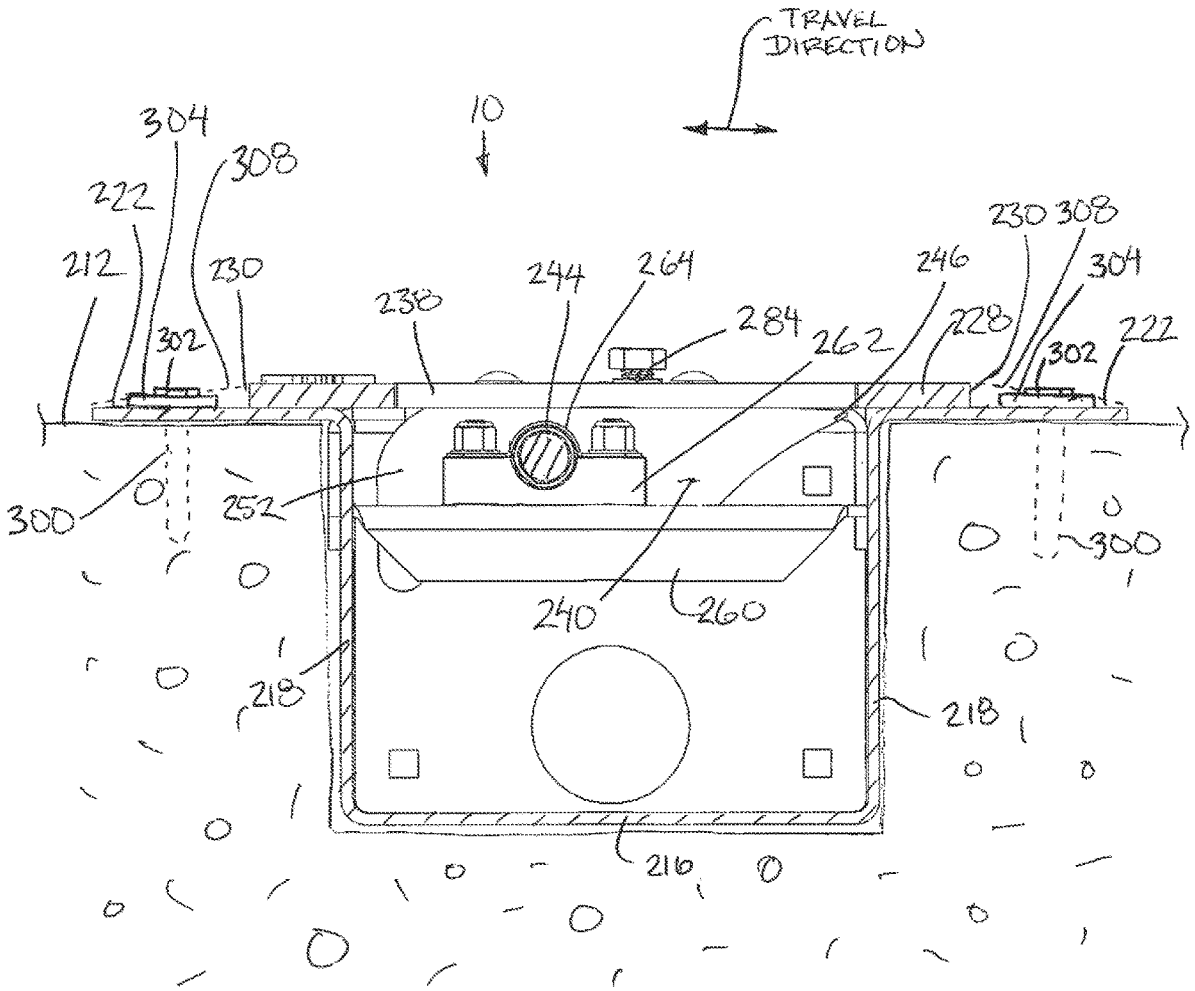
FIG. 19 is a sectional view along the line 18-18 in FIG. 17.
Figure 20:
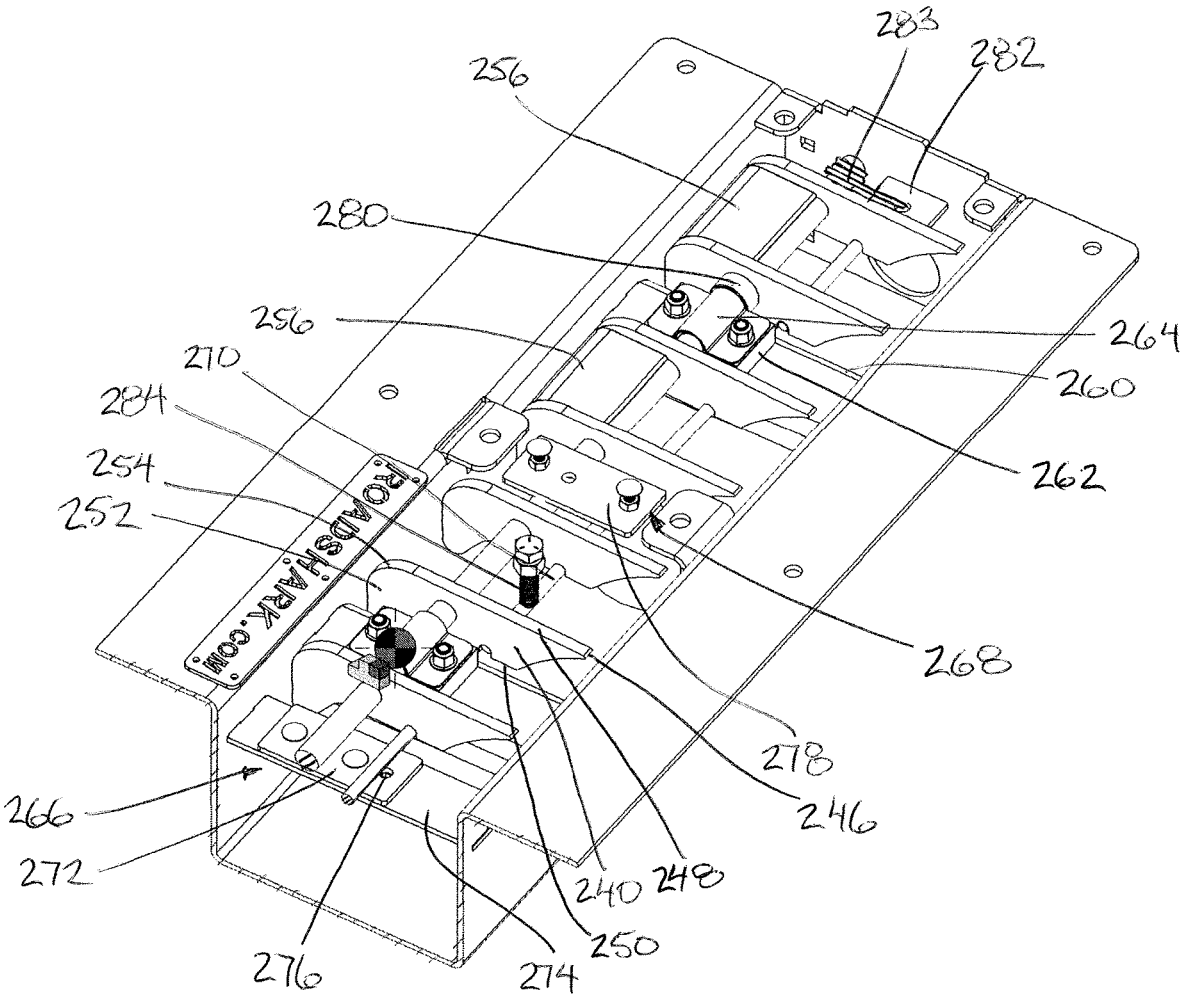
FIG. 20 is a partly sectional view along the line 19-19 in FIG. 17.
Figure 21:
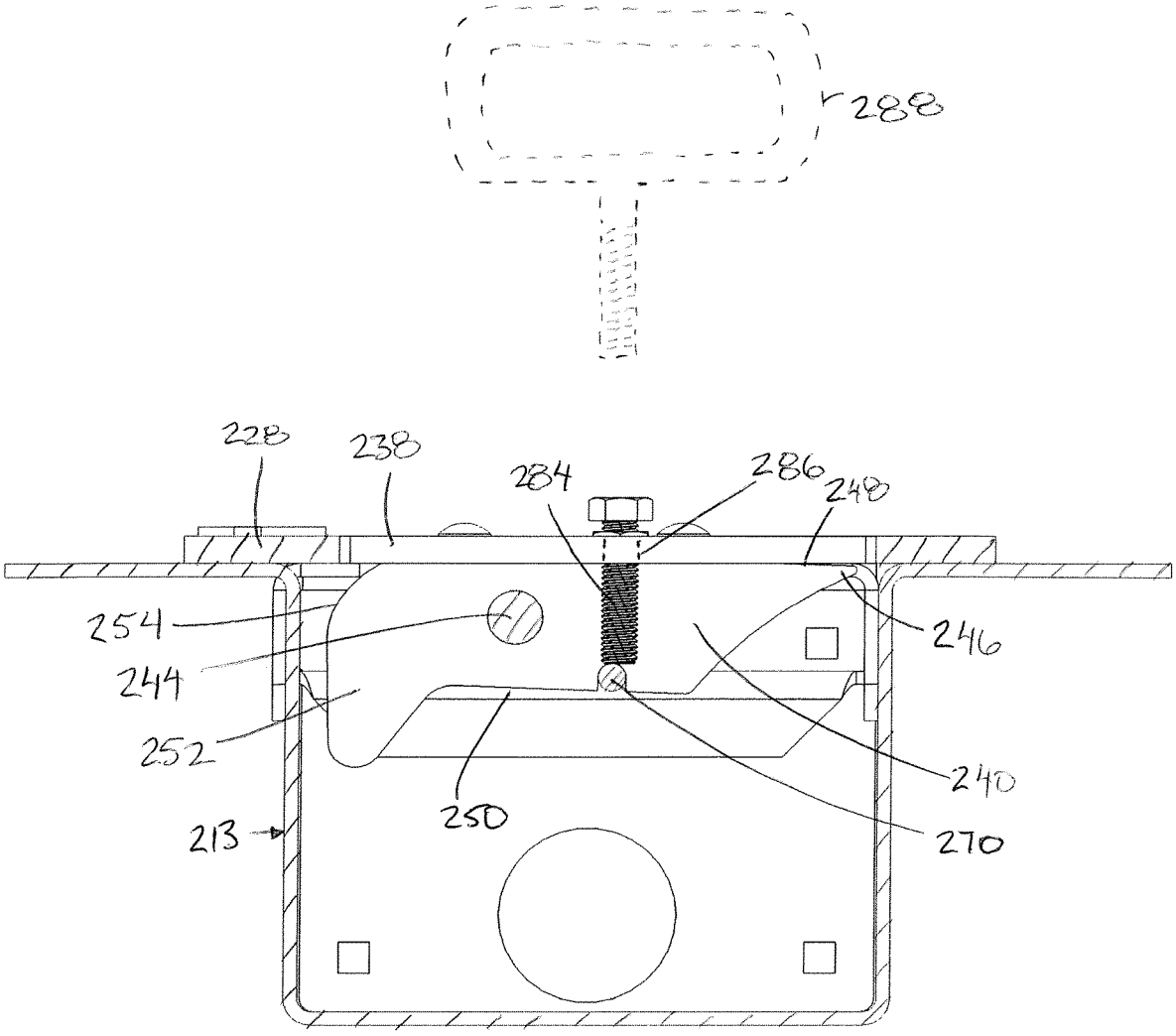
FIG. 21 is a sectional view along the line 20-20 in FIG. 17.
Figure 22:
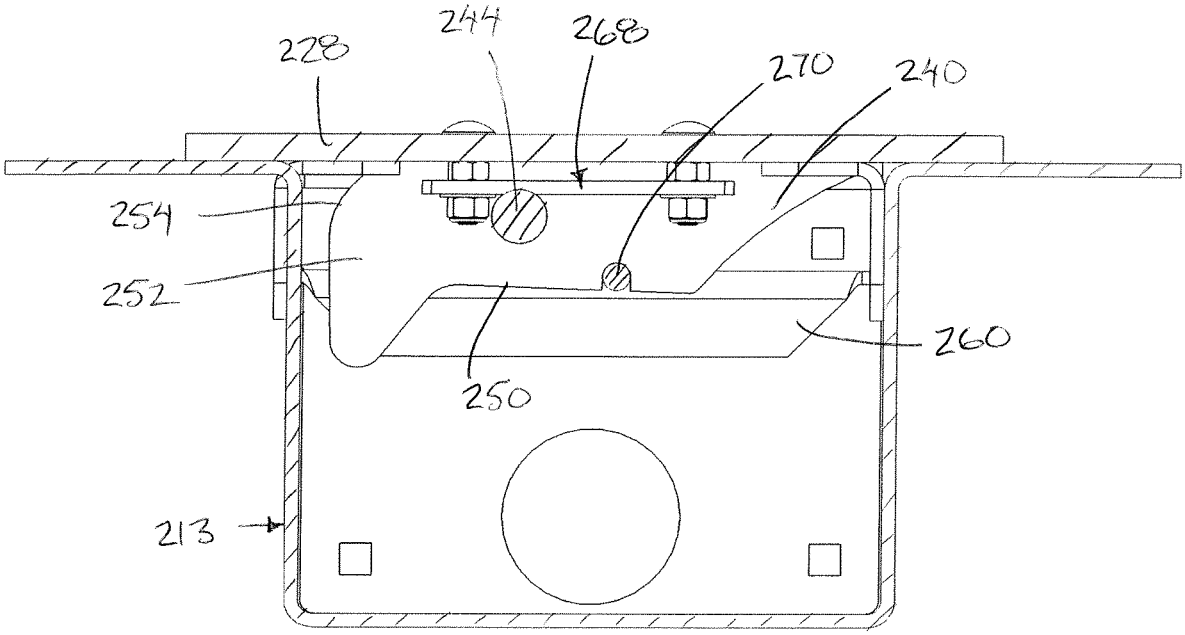
FIGS. 22 and 23 are sectional views along the line 21-21 in FIG. 17 illustrating the tire puncturing frame in the stored position and the working position relative to the upper stop member.
Figure 23:
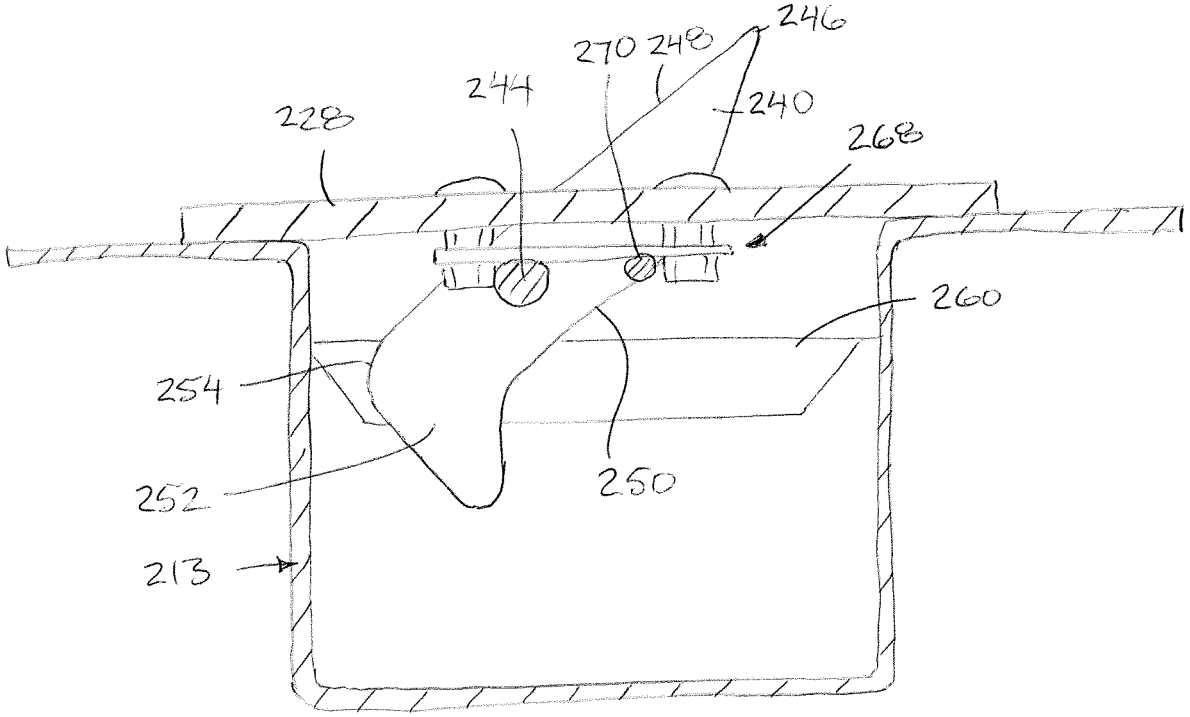
Figure 24:
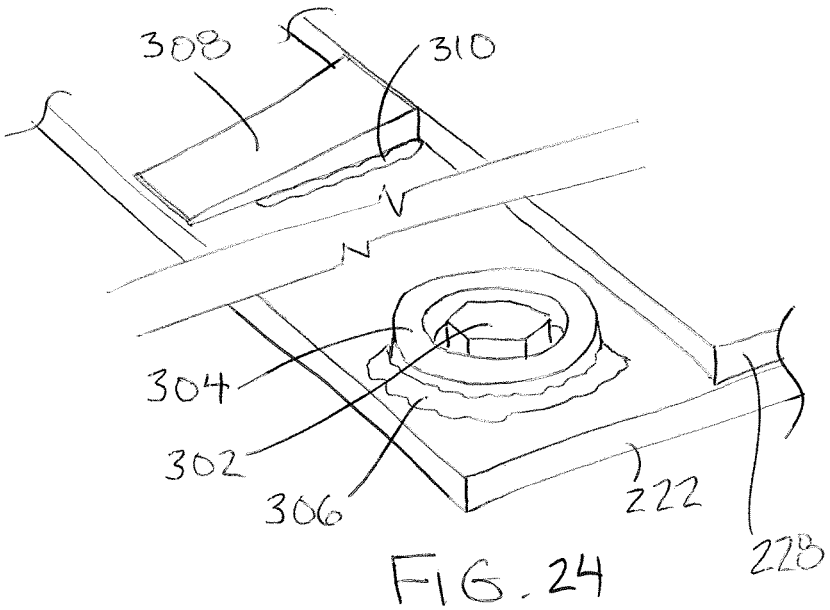
FIG. 24 is a perspective view of a bolt guard and a top plate guard supported on the lower housing of the device according to FIG. 16.

Turning now to the embodiment of FIG. 15, in this instance, the traffic control device is substantially identical to the embodiment of FIG. 16 with the exception of the shaft comprising a modular shaft having joiner plates 48 at opposing ends thereof together with a socket 56 at one end of the shaft and a protrusion 54 at the other end of the shaft similar to the embodiments of FIGS. 1 through 12 for connecting adjacent modular sections to one another.

Turning now to the embodiments of FIGS. 16 to 24, the traffic control devices 10 in this instance are at least partially recessed relative to the road surface of the roadway that supports the vehicular traffic thereon. The device 10 comprises a housing 213 which is mounted within a suitable trough formed in the roadway so as to be recessed relative to the upper road surface of the roadway. The housing is elongate in the longitudinal direction of the device between two opposed ends 214 of the housing while having a generally rectangular shape in cross section along the length of the housing between the opposing ends.

The housing 213 includes a bottom plate 216 which is rectangular in shape and horizontally oriented to span the full length of the housing between the opposing ends and to span the full width of the housing between laterally opposing side walls 218 of the housing in a lateral direction. The side walls 218 of the housing extend vertically upward from opposing side edges of the bottom plate 216 to similarly span the full length of the housing in the longitudinal direction between the opposing ends. A pair of end walls 220 enclose opposing ends of the housing between the side walls 218 to span the full height of the side walls.

The housing 213 further includes a pair of mounting flanges 222 that protrude laterally outwardly from the two side walls 218 respectively while spanning the full length of the housing in the longitudinal direction. The mounting flanges 222 lie in a common horizontal plane with one another and the top edges of the side walls 218 so as to be parallel to the bottom plate 216 of the housing. The housing is intended to be mounted within the trough formed in the roadway such that the mounting flanges 222 lie flat against the upper road surface of the roadway so that substantially the full height of the housing below the mounting flanges is recessed downwardly into the roadway relative to the road surface thereof.

A plurality of fastener apertures 224 are provided at longitudinally spaced positions along each mounting flange 222 to receive a suitable anchor penetrated therethrough such as a concrete fastener or concrete anchor 300 with a head 302 mounted against the top side of the mounting flange to hold the mounting flanges down against the upper road surface of the roadway and thereby maintain the housing mounted in fixed relation to the roadway.

To protect the protruding fastener heads 302 from being sheared off from street clearing equipment for example, a fastener guard 304 may be mounted on the top side of the mounting flange 222 in association with each fastener aperture 224. In the illustrated embodiment, the fastener guard comprises an annular ring of rigid metal which is fixed to the top side of the mounting flange 222, for example by welding, such that the guard 304 surrounds the respective aperture. A height of the guard 304 in the illustrated embodiment is slightly less than a height of the fastener head 302; however, the guard may be equal or greater in height than the head 302 in further embodiments. The guard 304 may be secured using a weld bead 306 about the outer circumference of the guard so as to form a ramped surface that assists in guiding passing equipment up and over the guard 304 which assists in guiding the passing equipment over the fastener head 302 as well, and thereby prevent shearing of the bolt head. An interior diameter of the guard 304 is sized so that the guard is spaced radially outward from the bolt about the full circumference thereof to define an annular space capable of receiving a socket wrench or other comparable tool about the fastener head without interference from the guard 304.

Additional fastener apertures 225 may be formed in the side walls and the end walls of the housing to receive additional fasteners or anchors which extend into the surrounding roadway to assist in mounting the housing in fixed relation to the roadway.

The side walls 218, the bottom plate 216, and the mounting flanges 222 may be formed of a common rigid plate of metal which has been suitably formed into the appropriate shape such that the side walls, the mounting flanges and the bottom plate form an integral and seamless unitary body of material upon which the end walls are mounted in fixed relation. The side walls, the end walls, the mounting flanges and the bottom plate collectively define a lower housing having an access opening at the top side thereof bounded by the top edges of the end walls 220 and the side walls 218 respectively. Various drain apertures 226 are located in the bottom wall and the end walls of the housing for draining any precipitation which may collect within the housing.

The housing 213 further includes a top plate 228 which is selectively mounted across the top of the housing for enclosing the access opening spanning the top side of the lower housing in a normal mounted position of the top plate relative to the lower housing. The top plate 228 is a rigid plate having sufficient strength to support vehicles rolling across the top plate as vehicles pass over the housing when travelling along the roadway in the travel direction. The top plate has suitable dimensions to span the full length of the housing in the longitudinal direction such that opposing ends of the top plate overlap over the top edge of both end plates. The top plate also fully spans the width of the access opening of the lower housing in the lateral direction by being sized to be slightly wider between opposing side edges of the top plate than the lateral width between the side walls 218 of the lower housing. In this manner, the opposing side edges 230 of the top plate overlap overtop the top side of the two mounting flanges 228 respectively at laterally opposing sides of the housing along the full length of the housing in the longitudinal direction.

To assist in locating the top plate in the longitudinal direction and in the lateral direction relative to the lower housing, each of the end walls includes a locator tab 232 projecting upwardly from the top edge of the end wall by a height corresponding approximately to the thickness of the top plate. Each end of the top plate 228 is provided with a corresponding recess extending longitudinally inward from the outer end thereof such that the recess is sized to receive the locator tab 232 therein in a mounted position with the top edge of the locator tabs being flush with the upper supporting surface of the top plate 228.

To further assist in locating the top plate relative to the lower housing and to fix the top plate from lifting off of the lower housing, the lower housing further includes a plurality of fastener flanges 234 which are fixed to respective ones of the side walls 218 or end walls 220 of the lower housing in which the flanges 234 extend horizontally inward from the respective wall of the housing so as to be parallel and coplanar with the mounting flanges 222 of the housing. In this manner, when the top plate 228 lies flat against of the upper surface of the mounting flanges 222, the top plate also lies flat against the upper surface of the fastener flanges 234. Cooperating apertures 236 are provided in each fastener flange 234 and at the corresponding location in the top plate 228 to enable threaded fasteners received through the cooperating apertures to fasten the top plate 228 releasably relative to the lower housing. The fastener flanges 234 are provided at laterally spaced apart positions on each end wall so as to be located in all four corners of the lower housing as well as being located at a plurality of longitudinally spaced apart positions along each side wall 218 to provide adequate structural support to retain the top plate in fixed relation to the lower housing.

As shown in the illustrated embodiment, when the top plate 228 overlaps over the top side of the mounting flanges 222, the opposing side edges of the top plate protrude upwardly from the mounting flanges in a manner that may cause street equipment such as the scraper blade of snow clearing equipment to be caught on the side edges while passing over the traffic control device. To protect the top plate from being engaged and sheared off of the housing by the street equipment passing over the traffic control device, additional guard members 308 are mounted on the top side of each of the mounting flanges 222. Each guard member 308 is mounted in fixed relation onto a respective one of the mounting flanges at an intermediate location between a respective adjacent pair of the fastener apertures 224. Each guard member 308 has an upper surface which is ramped in profile to extend laterally inwardly from an outer edge of the mounting flange 222 to the corresponding side edge of the top plate. At the inner end of the guard member 308, the height of the guard member is approximately equal to the thickness of the top plate. The lateral distance between the guard members 308 on one side of the traffic control device to the guard members 308 on the other side of the traffic control device is approximately equal to the lateral width of the top plate. In this manner, the guard members 308 serve to both (i) guide street equipment upwardly and over the top plate as the equipment passes over the traffic control device, and (ii) locate the top plate in the lateral direction relative to the lower housing. The guard members 308 may be fixed to the mounting flanges by weld beads 310 between the sides of the guard member 308 and the top side of the mounting flanges 222.

The top plate further includes a plurality of spaced apart upper openings 38 formed therein in which the upper openings are evenly spaced apart in the longitudinal direction of the housing. Each upper opening comprises an elongate slot which is parallel to the lateral direction and perpendicular to the longitudinal direction of the housing such that the upper openings are parallel to one another.

Each upper opening 238 cooperates with a respective tire puncturing member 240 in operation as described in further detail below.

The housing 213 receives a tire puncturing frame 242 therein in which the tire puncturing frame is a frame assembly comprised of the tire puncturing members 240 which are coupled in fixed relation to one another together with additional components of the tire puncturing frame as described herein such that the entirety of the tire puncturing frame acts as a unitary structure. More particularly the tire puncturing frame is supported within the housing for pivotal movement between a storage position in which the tire puncturing members are fully received within the housing below the upper supporting surface of the top plate of the housing and a working position in which a portion of the tire puncturing members of the tire puncturing frame protrude upwardly from the upper surface of the top plate of the housing for puncturing tires of vehicles travelling over the housing in a prescribed direction.

The tire puncturing frame 242 further includes a pivot shaft 244 which is oriented in the longitudinal direction and which defines the pivot axis of the pivotal movement of the tire puncturing frame relative to the housing. The tire puncturing members are mounted onto the pivot shaft 244 at evenly spaced apart positions in the longitudinal direction corresponding to the spacing of the upper openings 238 in the top plate of the housing such that each tire puncturing member is aligned with a corresponding one of the upper openings in the housing. The tire puncturing members 240 are mounted in fixed relation to the pivot shaft for pivotal movement together about the pivot axis thereof.

Each tire puncturing member 240 is formed of a flat rigid plate of material oriented within a respective vertical plane that is aligned in the lateral direction of the housing so as to be perpendicular to the longitudinal direction of the housing. The plate forming the tire puncturing member is pivotal within its respective plane between the stored position and the working position thereof.

Each tire puncturing member 240 includes a puncturing portion extending radially from the pivot axis in a common first direction towards a respective pointed apex 246 or pointed end of the member. The apexes 246 are all aligned with one another along a common imaginary axis which is parallel to the pivot axis.

In the stored position, a top edge 248 of the plate forming each tire puncturing member 240 is oriented to be parallel to and adjacent to the top plate 228 of the housing. The apex 246 is located at one end of the top edge 248 at the intersection of the top edge and an opposing lower edge 250 which is sloped upwardly and laterally outwardly to the apex in the stored position. More particularly, the apex 246 is located to be directly adjacent or in very close proximity to one of the side walls of the housing in the stored position.

In the working position, the top edge 248 extends upwardly and laterally outwardly at a slope with the apex 246 being located at the top end so as to be spaced above the upper supporting surface of the top plate of the housing.

Each tire puncturing member further includes a counter balance portion 252 in which all of the counterbalance portions extend from the shaft in a common second direction which is diametrically opposite from the corresponding apexes 246 extending in the first direction. The counterbalance portions 252 provide some balancing of the tire puncturing members 240 about the pivot axis thereof relative to the housing.

In the stored position, the top edge 248 of each tire puncturing member 240 extends laterally outward beyond the pivot axis opposite the apex 246 to a convex edge 254 which is curved laterally outwardly and downwardly into the housing so as to encourage any debris on the counter balance portion 252 to fall into the housing.

In the working position, the counterbalance portion 252 is pivoted downwardly towards the bottom of the housing relative to the stored position while remaining laterally offset from the pivot axis relative to the corresponding apex throughout a full range of motion of the tire puncturing frame between the stored and working positions thereof.

The tire puncturing frame 242 further includes a plurality of counterweights 256 mounted in fixed relation thereon so as to be pivotal together with the frame about the pivot axis relative to the housing. Each counterweight 256 mounts to span a longitudinal gap between a respective pair of the tire puncturing members 40 in connection between the counterbalance portions 252 thereof such that each counterweight is offset laterally from the pivot axis of the frame opposite to the apex 246 throughout the full range of motion of the frame between the stored and working positions thereof.

The counterweights have a substantial mass such that the counterweights provide a biasing under action of gravity alone to bias the entire tire puncturing frame 242 from the stored position towards the working position throughout the full range of motion thereof. For example, a force in the range of 10 to 20 pounds must be applied downwardly to one of the apexes 246, or distributed across a plurality of the apexes, in order to overcome the biasing effect of the counterweights and pivot the tire puncturing frame from the working position to the stored position thereof. Each counterweight has an upper surface 258 which follows the contour of the corresponding pair of tire puncturing members so as to be substantially flush with the top edge and the convex edge 254 thereof across the width of the counterbalance portion.

The number of counterweights is selected to provide sufficient mass to provide adequate biasing of the tire puncturing frame towards the working position without causing interference of the counterweights with other components of the traffic control device. In the illustrated embodiment, a series of 12 tire puncturing members 240 are provided in the housing which define six adjacent pairs; however, only four counterweights are provided in this instance to provide space between other adjacent pairs of the members for accommodating other components of the device as described in the following.

In order to support the tire puncturing frame 242 for pivotal movement within the housing, the pivot shaft 244 thereof is pivotally supported at a plurality of longitudinally spaced apart locations. At each supporting location, a housing crossbar 260 is connected laterally between the opposed side walls 218 of the housing in fixed relation thereto at an intermediate location between the top and bottom side of the housing. A bushing block 262 is supported upon the crossbar in which the bushing block is formed of a plastic material having a low coefficient of friction. A semicircular recess is provided in an upper surface of the bushing block in which the recess spans the full width of the block in the longitudinal direction to receive a portion of the pivot shaft 244 cradled therein so that the pivot shaft is rotatable relative to the bushing block.

A cover plate 264 is provided for mounting above the bushing block using threaded fasteners at laterally opposed ends of the cover plate to secure the pivot shaft rotatably against the bushing block. The cover plate includes a semicircular formation thereon connected between a pair of opposing fastener flanges such that the semicircular formation extends partway about the circumference of the pivot shaft opposite the corresponding recess in the bushing block 262. The cover plate may include a lining of plastic material having a low coefficient of friction similar to the bushing block.

Threaded fasteners are penetrated through the fastener apertures in the flanges at opposing ends of the cover plate 264 so that the fasteners also extend through corresponding apertures in the bushing block 262 and in the housing crossbar 260 therebelow to retain the tire puncturing frame for pivotal movement about a common pivot axis of the bearing box in the mounted position within the housing. The housing crossbars 260 are each located between an adjacent pair of tire puncturing members 240 at a location where there is no counterweight 256 such that there is no interference therebetween.

The traffic control device 210 further includes a lower stop member 266 defining a lower limit to be engaged by the pivoting tire puncturing frame 242 in the stored position, and a pair of upper stop members 268 defining an upper limit to be engaged by the pivoting tire puncturing frame 242 in the working position. More particularly, the tire puncturing frame includes a plurality of frame crossbars 270 fixed thereon for pivoting together with the tire puncturing members between the stored and working positions thereof such that the frame crossbars 270 engage the upper and lower stop members in the working position and the stored position respectively.

Each frame crossbar 270 is connected between an adjacent pair of the tire puncturing members 240 at a location which is not occupied by one of the housing crossbars 260 so as to avoid any interference therebetween. The crossbars 270 on the frame 242 are all aligned along a common axis which is parallel to the pivot axis of the frame at a location offset towards the apexes in a common lateral direction from the pivot axis throughout a full range of motion of the frame between the stored and working positions thereof. Throughout the full range of motion of the tire puncturing frame, the frame crossbars 270 engage the lower stop member 266 at a location below the elevation of the pivot axis in the stored position and engage the upper stop members at a location above the elevation of the pivot axis in the working position.

The lower stop member 266 comprises a pad 272 of resilient material supported on an auxiliary crossbar 274 that is fixed relative to the lower housing. The auxiliary crossbar 274 extends in the lateral direction between opposing side walls 218 of the lower housing between an adjacent pair of the tire puncturing members 240 at a location which is not occupied by any of the housing crossbars 260 or the counterweights 256. The resilient pad 272 is mounted on the top side of the rigid auxiliary crossbar using threaded fasteners penetrated through the pad and the crossbar at laterally opposing ends of the pad so as to receive a corresponding one of the frame crossbars 270 engaged at an intermediate location thereon in the stored position to prevent further pivotal movement of the tire puncturing frame beyond the stored position. Varying the thickness of the pad 272 mounted on the crossbar enables the height of the apexes of the tire puncturing members to be calibrated in elevation relative to the housing in the stored position.

The pads 272 forming the lower stop member 266 may also be replaced with a cushion member 412 as described above with regard to FIG. 14 which dampens the downward movement of the tire puncturing members towards the stored position following an impact from a vehicle passing over the device 10.

An optional fastener aperture 276 is provided on the auxiliary crossbar in proximity to the location of engagement of the corresponding frame crossbar 270 of the tire puncturing frame to enable a suitable fastener received within the aperture 276 to engage the frame crossbar 270 of the tire puncturing frame and clamp the frame crossbar against the resilient pad 272 in a manner which selectively retains the tire puncturing frame in the stored position until the fastener is removed from the aperture 276.

Two upper stop members 268 are provided within the housing at longitudinally spaced apart locations immediately below the top plate 228 of the housing. More particularly each upper stop member 268 is secured to the underside of the top plate using threaded fasteners penetrated through laterally opposing ends of a pad 278 of resilient material forming the upper stop member such that the fasteners can also be penetrated through corresponding fastener apertures in the top plate. Each upper stop member is coupled to the top plate at a location which is centered longitudinally between a pair of the upper openings 238 in the top plate. The pad 278 forming each upper stop member is positioned such that a central location on the upper stop member between the fasteners at opposing ends thereof is aligned with a corresponding one of the frame crossbars 270 on the tire puncturing frame when the tire puncturing frame is pivoted into the working position. By varying the thickness of the pad 278 or the number of stacked pads fastened to the underside of the top plate, the height of the bottom of the lowermost pad relative to the upper surface of the housing can be adjusted which in turn adjusts the elevation of the upper limit engaged by the tire puncturing frame in the working position so as to vary the height of the apexes of the tire puncturing frame relative to the upper surface of the housing in the working position.

The material of the pad 278 defining in the upper stop member can also be varied, such that a softer material reduces noise and a harder material has a longer life.

In the illustrated embodiment, the pair of fasteners securing each pad 278 to the top plate of the housing includes a head engaged upon the upper surface of the housing and a threaded shaft penetrated downwardly through a corresponding aperture in the top plate of the housing to receive a spacer about the shaft engaged upon the bottom of the top plate of the housing such that the pad 278 is supported in a spaced apart relationship below the bottom surface of the top plate 228 of the housing. A central portion of the pad 278 between the fasteners at opposing ends thereof is thus effectively suspended in spaced apart relationship below the top plate of the housing thereabove at the location of engagement of the corresponding frame crossbar 270 of the tire puncturing frame thereon in the working position. Due to the resilient nature of the pad 278, the material of the pad can both be compressed and resiliently deflected upwardly towards the top plate thereabove to a small degree to provide some cushioning effect that absorbs the impact of the tire puncturing frame pivoting into the working position under the biasing force of the counterweights in the absence of any actuating force being applied to the portions of the tire puncturing members protruding above the upper surface of the housing.

The pivot shaft 244 is arranged to be longitudinally slidable within the respective bushing blocks 262 to allow some limited re-adjustment of the tire puncturing frame relative to the housing in the longitudinal direction. This serves to calibrate the positioning of the tire puncturing frame relative to the housing to ensure that the tire puncturing members are aligned with corresponding ones of the upper apertures 238 in the top plate 228 of the housing. Once the tire puncturing frame has been aligned longitudinally with the housing, the selected positioning of the frame relative to the housing can be set using one or more positioning collars 280 which are supported about the pivot shaft 244. Each collar is a lock member that is longitudinally slidable along the pivot shaft to a desired mounting location at which point a set screw threaded radially into the collar 280 can be tightened so that the engagement of the inner end of the set screw against the shaft fixes the location of the collar relative to the shaft. The collars 280 can be abutted axially against longitudinally opposing ends of one or more bearing blocks in a manner that restricts longitudinal sliding of the tire puncturing frame relative to the housing while not interfering with pivoting movement thereof relative to the housing between the stored and working positions thereof. Although the pivot shaft is axially slidable relative to the housing through a range of axial positions, the lock member defined by the collar 280 is supported on the pivot shaft so as to fix the pivot shaft relative to the housing at a selected one of the axial positions while enabling pivotal movement of the pivot shaft relative to the housing.

In some instances, it is desirable to supplement the biasing force provided by the counter weights 256 by using additional springs. An anchor flange 282 is provided at an intermediate location to extend horizontally inward from each of the end plates 220 of the housing. A torsion spring 283 can be mounted about the end of the pivot shaft 244 at each of the opposing ends of the housing such that opposing ends of each torsion spring can be fixed to the anchor flange 282 and a corresponding anchoring location on the adjacent one of the tire puncturing members 240 respectively so that the springs each provide additional biasing force to assist in biasing of the tire puncturing frame from the stored position towards the working position. When no springs are used, the actuation force that is required to be applied downwardly onto the apex of one of the tire puncturing members in the working position may be in the range of 10 to 20 pounds to pivot the tire puncturing frame into the stored position; however, when using additional springs at both ends, the actuating force to pivot the tire puncturing frame into the stored position from the working position may be increased to 40 to 60 pounds for example. Using only one spring will result in an intermediate actuating force being required for example. The use of one or two springs may be a temporary measure used only until the bearings have exceeded a break-in period for example.

In order to retain the tire puncturing frame in the stored position for a long duration, a latch bolt 284 may be used as a latch member to fix the tire puncturing frame in the stored position. In this instance a threaded aperture 286 is provided in the top plate which is aligned with a corresponding one of the frame crossbars 270 in the stored position so that the aperture 286 receives the latch bolt 284 threaded therein with the inner end of the latch bolt engaging the frame crossbar 270 to prevent upward pivoting of the crossbar and the connected tire puncturing frame from the stored position towards the working position thereof. The latch bolt 284 is sized such that when the head of the bolt is engaged against the upper surface of the top plate, the threaded shaft of the latch bolt spans the appropriate height from the upper surface of the top plate to the top side of a corresponding one of the frame crossbars 270 in the stored position to prevent upward movement of the crossbar from the stored position.

Optionally, a suitable carrying handle 288 may be provided having a handle portion size for gripping in the hand of a user and a threaded shaft connected in fixed relation thereto having similar threads as the latch bolt such that the handle 288 and the latch bolt 284 can be interchangeably mounted within the corresponding threaded aperture 286 in the top plate. In this manner, the threaded shaft of the handle can be used as a latch bolt to retain the tire puncturing frame in the stored position while simultaneously providing a temporary handle which is useful for handling and positioning of the device during installation in a roadway for example.

In further embodiments, for retaining the tire puncturing frame in the stored position, a latch pin receiving aperture may be located in a vertical orientation through any component of the tire puncturing frame, including an auxiliary tab formed on the shaft or on one of the tire puncturing members. The latch pin receiving aperture is provided on the frame at a location such that the aperture is aligned with a corresponding aperture in the top plate in the stored position. In this instance a latch pin having an elongate shaft may be slidably inserted through the aperture in the top plate and the corresponding aperture in the tire puncturing frame in a manner that prevents the tire puncturing frame from pivoting away from the stored position.

Although the illustrated embodiment of the traffic control device shown in the accompanying figures is intended for in-ground installation recessed relative to the upper surface of a roadway, numerous operating components of the traffic control device as described above may be readily adapted for use in a traffic control device having a housing which is instead adapted for flush mounting fully above the upper surface of the roadway.

According to the illustrated embodiment, the traffic control device is installed in a roadway such that the longitudinal direction of the housing is oriented perpendicularly to a travel direction of vehicular traffic on the roadway. Installation may involve forming a trench in the roadway into which the housing is recessed. If it is desirable to maintain the device in the stored position, one of various latching means described above may be used long-term. When it is desired to operate the traffic control device for puncturing tires of the vehicles travelling over the device in one prescribed direction only, the latching devices are removed such that the counterweights automatically bias the tire puncturing frame into the working position. Due to the upwardly sloped orientation of the top edge of the tire puncturing members towards an apex at one end that is laterally offset from the pivot axis of the frame, vehicles rolling over the device opposite to the offset direction of the apexes of the tire puncturing members will cause the apexes to penetrate and puncture tires of the vehicle. Alternatively, vehicles passing in the opposing direction corresponding to the lateral direction that the tire puncturing members extend from the pivot axis to the apexes thereof, the rolling action of the tires across the upper surface of the top plate of the housing cause the tire puncturing members to be deflected downwardly into the stored position to allow a vehicle to fully pass over the housing without damaging the tires.

Due to the top plate being secured with removable threaded fasteners, ready access can be provided to the lower housing and the operating components therein. Once the top plate is removed, removal of simple threaded fasteners associated with each bushing block enables the cover plates of the bushings to be readily removed so that the entire tire puncturing frame can be removed and interchange if desired without the bushing blocks 262 being required to be removed from the housing and without requiring the tire puncturing members to be removed from the pivot shaft. Interchanging the tire puncturing frame may be desired where it is desired to vary the profile of the tire puncturing members to vary the aggressiveness of the apexes in terms of their ability to puncture tires.

Removal of the top plate also provides ready access for attaching or removing springs to complement the biasing provided by the counterweights. Access is also provided for varying the height of the upper and lower stop members to calibrate the positioning of the tire puncturing members in either of the stored or working positions thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A traffic control module for use with a roadway receiving vehicles travelling longitudinally along the roadway in a travel direction, the traffic control module comprising:

a main housing which is elongate in a longitudinal direction and which is adapted to be mounted to extend across the roadway transversely to the travel direction;

the main housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein;

a joiner plate fixed onto each end of the shaft assembly so as to be rotatable with the shaft assembly relative to the housing, each joiner plate locating at least one fastener aperture therein such that the joiner plate is adapted to be rigidly connected to a corresponding joiner plate of an auxiliary module of identical configuration to the traffic control module when the housings of the modules are longitudinally in series with one another such that the tire puncturing members of the modules are pivotal together between the storage positions and the working positions thereof;

wherein each joiner plate that locates said at least one fastener aperture therein lies perpendicularly to the shaft and wherein said at least one fastener aperture extends through the joiner plate parallel to said common pivot axis at a location spaced radially from the shaft assembly and is configured to receive a fastener rigidly coupling the joiner plate of the traffic control module to the corresponding joiner plate such that the fastener lies parallel to said common pivot axis at a location spaced radially from the shaft assembly.

2. The traffic control module according to claim 1 wherein at least one of the joiner plates includes a pointed end which pivots together with the pointed ends of the tire puncturing members between the storage position below the upper supporting surface and the working position protruding upwardly beyond the upper supporting surface so as to be adapted for puncturing tires.

3. The traffic control module according to claim 2 wherein the tire puncturing members are evenly spaced apart along the pivot axis from one another by a prescribed spacing and wherein each joiner plate is spaced along the pivot axis from an outermost one of the tire puncturing members by said prescribed spacing.

4. The traffic control module according to claim 2 wherein each joiner plate has a thickness in an axial direction of the shaft assembly which is approximately half of a thickness of each tire puncturing member.

5. The traffic control module according to claim 1 wherein one of the joiner plates includes a socket formed therein and the other joiner plate includes a protrusion formed therein which is arranged to be matingly received within the socket of the joiner plate of the auxiliary module of identical configuration when the joiner plates are rigidly connected.

6. The traffic control module according to claim 1 in combination with a controller module comprising:

a main housing which is elongate in a longitudinal direction between a first end and a second end and which is adapted to be mounted to extend across the roadway transversely to the travel direction;

the main housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein;

a controller housing connected to the first end of the main housing;

an actuating linkage within the controller housing in connection with a first end of the shaft assembly of the controller module for displacing the tire puncturing members of the controller module between the storage and working positions; and a joiner plate supported at a second end of the shaft assembly, the joiner plate being adapted to be coupled to the joiner plate of the traffic control module when the controller module and the traffic control module are positioned longitudinally in series with one another such that the tire puncturing members of the modules are pivotal together between the storage positions and the working positions thereof.

7. The traffic control module according to claim 6 wherein the traffic control module and the controller module are substantially equal in length in the longitudinal direction.

8. The traffic control module according to claim 6 wherein the controller housing supports an indicator assembly thereon including a first indicator which is visually indicative of the tire puncturing members being in the storage position and a second indicator which is visually indicative of the tire puncturing members being in the working position.

9. The traffic control module according to claim 1 wherein the shaft assembly protrudes longitudinally beyond the main housing at both ends of the shaft assembly such that the joiner plates at both ends of the shaft assembly are supported externally of the housing.

10. The traffic control module according to claim 9 in combination with said auxiliary module, wherein the main housing of the auxiliary module and the main housing of the traffic control module are longitudinally spaced apart when the joiner plates of the modules are rigidly connected to one another.

11. The traffic control module according to claim 10 wherein the traffic control module is adapted to be supported fully above an upper road surface of the roadway.

12. The traffic control module according to claim 1 wherein a first end of the shaft assembly protrudes longitudinally beyond the main housing such that the joiner plate at the first end is supported externally of the housing and a second end of the shaft assembly is recessed longitudinally inwardly relative to a corresponding end of the main housing such that the joiner plate at the second end is supporting internally within the housing.

13. The traffic control module according to claim 12 in combination with said auxiliary module, wherein the main housing of the auxiliary module and the main housing of the traffic control module are coupled in abutment with one another when the joiner plates of the modules are rigidly connected to one another.

14. The traffic control module according to claim 12 wherein the traffic control module is adapted to be supported at least partially recessed below an upper road surface of the roadway.

15. A traffic control device for use with a roadway receiving vehicles travelling longitudinally along the roadway in a travel direction, the device comprising at least two modules in which each module comprises:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein; and a joiner plate fixed onto one end of the shaft assembly such that the joiner plate is rotatable with the shaft assembly relative to the housing;

the joiner plate of each module lies perpendicularly to the shaft assembly of that module; and the joiner plates of the two modules being abutted directly against one another and rigidly connected to one another by a fastener connected between the joiner plates at a location spaced radially outward from the shaft assembly such that (i) the tire puncturing members of the modules are pivotal together between the storage positions and the working positions thereof and (ii) the joiner plates remain selectively separable from one another such that the two modules can be separated from one another.

16. The traffic control device according to claim 15 wherein at least one of the joiner plates includes a pointed end which pivots together with the pointed ends of the tire puncturing members between the storage position below the upper supporting surface and the working position protruding upwardly beyond the upper supporting surface so as to be adapted for puncturing tires.

17. The traffic control device according to claim 16 wherein the tire puncturing members are evenly spaced apart along the pivot axis from one another by a prescribed spacing and wherein each joiner plate is spaced along the pivot axis from an adjacent one of the tire puncturing members along the same shaft assembly by said prescribed spacing.

18. The traffic control device according to claim 15 wherein the joiner plates of both of the modules are supported longitudinally spaced beyond corresponding ends of the respective main housings such that the joiner plates are supported externally of both of the main housings when the joiner plates are rigidly connected and the main housings of the two modules are longitudinally spaced apart.

19. The traffic control device according to claim 15 the joiner plate of one of the modules is supported longitudinally spaced beyond a corresponding end of the respective main housing and the joiner plate of another one of the modules is supported recessed inwardly relative to a corresponding end of the respect main housing such that both joiner plates are received within a common one of the main housings when the joiner plates are rigidly connected and the main housings of the two modules are coupled in abutment within one another.

20. A traffic control module for use with a roadway receiving vehicles travelling longitudinally along the roadway in a travel direction, the traffic control module comprising:

a main housing which is elongate in a longitudinal direction and which is adapted to be mounted to extend across the roadway transversely to the travel direction;

the main housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

a shaft assembly coupling the tire puncturing members so as to be pivotal together relative to the housing about a common pivot axis between a storage position in which the tire puncturing members are retracted below the upper supporting surface of the housing and a working position in which the pointed ends of the tire puncturing members protrude upwardly beyond the upper supporting surface of the housing through the upper openings formed therein; and a joiner plate supported at each end of the shaft assembly locating at least one fastener aperture therein such that the joiner plate is adapted to be rigidly connected to the joiner plate of an auxiliary module of identical configuration to the traffic control module when the housings of the modules are longitudinally in series with one another such that the tire puncturing members of the modules are pivotal together between the storage positions and the working positions thereof;

wherein at least one of the joiner plates includes a pointed end which pivots together with the pointed ends of the tire puncturing members between the storage position below the upper supporting surface and the working position protruding upwardly beyond the upper supporting surface so as to be adapted for puncturing tires.

* * * * *